US006106014A

United States Patent [19]

Werner et al.

[11] Patent Number: 6,106,014

[45] **Date of Patent: *Aug. 22, 2000**

[54] PACKET FOR STORING PHOTO-RELATED PRODUCTS

[76] Inventors: Richard S. Werner, 326 Cedar Sauk Rd., West Bend, Wis. 53095; Carey P. Woods, N4390-130th St., Plum City, Wis. 54761

[ * ] Notice: This patent is subject to a terminal disclaimer.

[21] Appl. No.: 09/141,615

[22] Filed: Aug. 28, 1998

Related U.S. Application Data

[60] Division of application No. 08/803,039, Feb. 19, 1997, Pat. No. 5,823,330, which is a continuation-in-part of application No. 08/713,111, Sep. 16, 1996, Pat. No. 5,833,059, which is a continuation-in-part of application No. 08/605,970, Feb. 23, 1996, Pat. No. 5,704,472.

[51] Int. Cl.[7] ..... B42D 1/08

[52] U.S. Cl. ..... 281/22; 206/316.1; 281/38; 402/72

[58] Field of Search ..... 206/316.1; 281/38, 281/22; 402/79

[56] References Cited

U.S. PATENT DOCUMENTS

| | | | |
|---|---|---|---|
| 5,000,319 | 3/1991 | Mermelstein | 206/455 |
| 5,251,746 | 10/1993 | Gresh et al. | 206/232 |
| 5,263,579 | 11/1993 | Blackman | 206/232 |
| 5,301,803 | 4/1994 | Hansen et al. | 206/232 |
| 5,303,825 | 4/1994 | Hansen et al. | 206/232 |
| 5,374,975 | 12/1994 | Amat | 355/75 |
| 5,431,449 | 7/1995 | Arimoto et al. | 281/31 |
| 5,459,549 | 10/1995 | Barr | 355/85 |
| 5,546,155 | 8/1996 | Yamamoto | 354/354 |
| 5,704,472 | 1/1998 | Werner et al. | 206/232 |
| 5,709,496 | 1/1998 | Werner et al. | 402/79 |
| 5,788,074 | 8/1998 | Tanabe et al. | 206/455 |
| 5,823,330 | 10/1998 | Werner et al. | 206/232 |
| 5,833,059 | 11/1998 | Werner et al. | 206/232 |

*Primary Examiner*—Andrea L. Pitts
*Assistant Examiner*—Monica S. Carter
*Attorney, Agent, or Firm*—Jansson, Shupe, Bridge & Mungei, Ltd.

[57] ABSTRACT

A photo/photo cartridge delivery/storage packet is particularly suited for the products of Advanced Photo Systems (APS) processing. Such packet has first and second sheet-like cover members disposed in spaced, substantially parallel planes. Each member has a spine-adjacent edge and a sheet-like spine interconnecting the cover members along such edges. A plurality of sheet-like photos is between the cover members and is removably/replaceably secured to the spine by adhesive. There is a structural element against either the second cover member or an additional insert card for securing the photo cartridge associated with the photos. The packet may also have a fold-over flap which aids in securing the photographs in the packet.

4 Claims, 19 Drawing Sheets

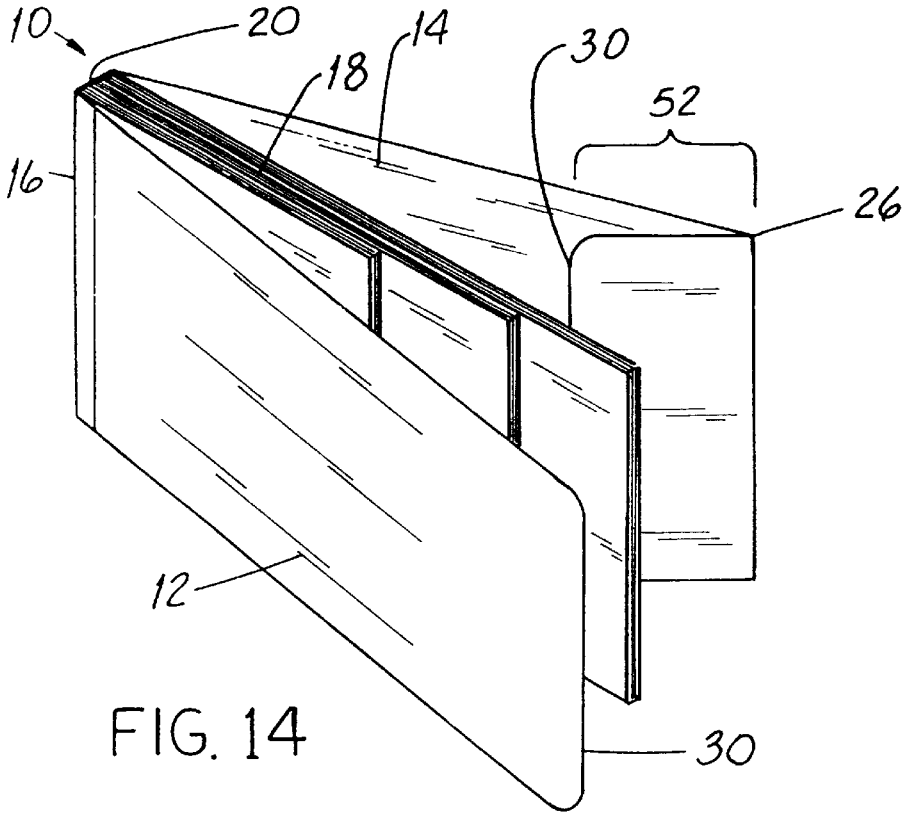
FIG. 14
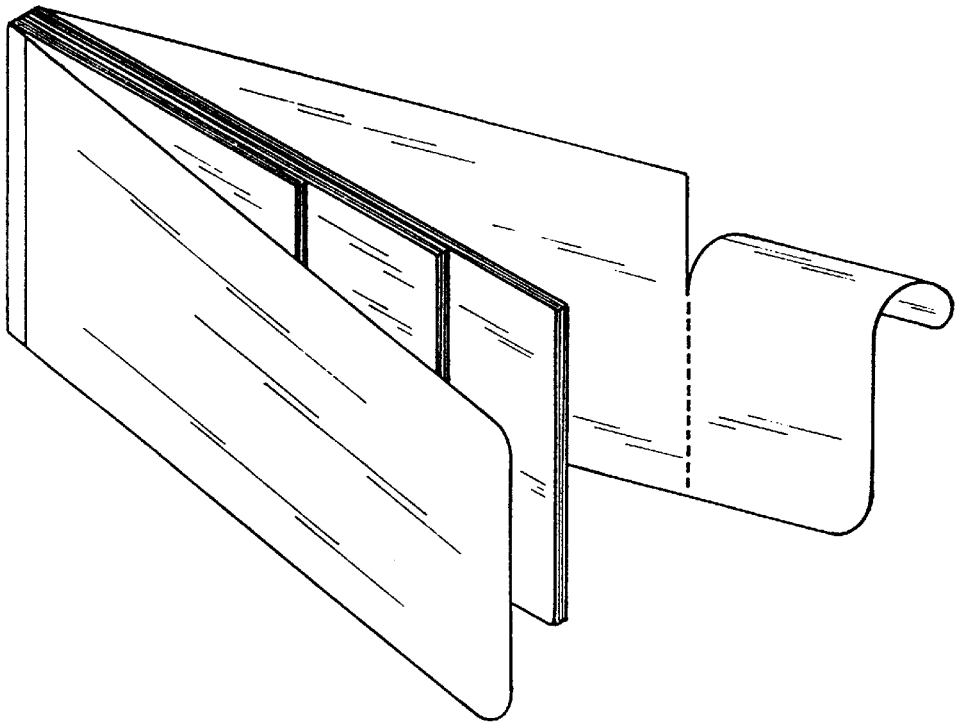

PACKET FOR STORING PHOTO-RELATED PRODUCTS

RELATED APPLICATIONS

This application is a division of application Ser. No. 08/803,039 filed Feb. 19, 1997, now U.S. Pat. No. 5,823,330, which is a continuation-in-part of Ser. No. 08/713,111 filed Sep. 16, 1996, now U.S. Pat. No. 5,833,059, which is a continuation-in-part of Ser. No. 08/605,970 filed Feb. 23, 1996, now U.S. Pat. No. 5,704,472.

FIELD OF THE INVENTION

This invention relates to the storing and protection of developed film and printed photographs in general, and more specifically, to film developed and photographs printed using the Advanced Photo System.

BACKGROUND OF THE INVENTION

The Advanced Photo System ("APS") is a new process related to the field of photography. With the APS, information regarding the film speed, emulsion details and photograph length will be magnetically recorded on the film. When a photograph is being taken, the camera reads the information on the film and can then automatically add exposure information in order to correct for lighting errors. These corrections result in better photo-finishing.

Using the APS, a photographer will be able to preselect the size of his finished photographic print prior to the taking of a picture. This feature will allow an individual to take pictures of various sizes using the same role of film.

Because print information is digitized on to the film, the developed film will remain in the original film canister. Because the consumer will no longer be receiving the familiar film strips, commonly called "negatives," they will be provided with an index card—much like a proof sheet—along with their printed photographs. The index card will show miniversions of all of the pictures on a particular role of film. Because the developed film will be returned in its original canister, a new device is needed that will allow the consumer to store the printed photographs and film canister together.

Conventional methods of storing developed film and photographic prints have involved the use of photo albums comprised of loose-leaf transparent film storing sheets equipped with a number of small pockets. These pockets are sized such that a printed photograph can be inserted into each one. Developed film or negatives, are stored in similar pockets that are sized to accommodate the pre-cut strips of exposed film. These pages are usually bound together by the use of some mechanical retainer such as a three-ring binder.

Another method of storing photos is disclosed in U.S. Pat. No. 5,040,216 (Policht). This method involves taping the edge of a photograph to a binder member having a two adhesive-coated strip attached to it. The binder members are then bound together by the use of retainers located at opposite end of the album's spine. Negative sheets are stored in a pocket located in one of the album's covers. A major drawback of this device is that it will not allow for the storage of the film cartridge used by the APS. An additional drawback is that only photographs of the same size can be conveniently stored in the same album.

U.S. Pat. No. 5,431,449 (Arimoto et al.) discloses a film storing sheet that provides for the storage of an index print on which the images recorded on a developed film are reproduced. The Arimoto patent also uses a film sheet having a plurality of small pockets to store the developed film.

As with other patents involving photo albums, the major drawback associated with the Arimoto patent is that it does not permit the combined storage of the APS photo cartridge, the index print, and the printed photographs.

There are a number of drawbacks and shortcomings associated with various arrangements and devices in the prior art. This invention relates to a unique solution, and a variety of preferred solutions to such problems. A photo-storage package that allows for the combined storage of the APS photo cartridge, the index print, and printed photographs of various sizes would be an important advancement in the art.

OBJECTS OF THE INVENTION

An object of the invention is to provide a photo/photo-cartridge delivery/storage packet that overcomes some of the problems and shortcomings of the prior art.

An object of the invention is to provide a photo/photo-cartridge delivery/storage packet that allows for the combined storage of the APS film cartridge, index print, and printed photographs.

Another object of the invention is to provide an original sale package for the APS film cartridge that allows for the storage of the processed film and printed photographs.

Yet another object of the invention is to provide a photo/photo-cartridge delivery/storage packet that provides the capability for attaching to the package, the original retail package of the APS film cartridge or parts thereof.

Still another object of the invention is to provide a photo/photo-cartridge delivery/storage packet that provides a separate storage container for the APS film cartridge, either by itself or in combination with the index print, that can be stored on a separate surface.

Another object of the invention is to provide a photo/photo-cartridge delivery/storage packet that allows for the storage of printed photographs of various sizes that are produced using the APS process.

Still another object of the invention is to provide a photo/photo-cartridge delivery/storage packet that allows for the easy removal and replacement of the printed photographs produced using the APS process.

Yet another object of the invention is to provide a photo/photo-cartridge delivery/storage packet that allows for the storage of printed photographs of various sizes separate from the APS film cartridge along with the index print.

Another object of the invention is to provide a photo/photo-cartridge delivery/storage packet for the APS that can be hung from a retail display.

Still another object of the invention is to provide a photo/photo-cartridge delivery/storage packet for the APS that allows for easy removal and replacement of the APS film cartridge.

Still another object of the invention is to provide a photo/photo-cartridge delivery/storage packet that allows the container housing the APS film cartridge to be stored on another surface.

Another object of the invention is to provide a photo/photo-cartridge delivery/storage packet for the APS that doubles as a photo album.

SUMMARY OF THE INVENTION

The invention involves a photo/photo cartridge delivery/storage packet for the products of Advanced Photo Systems (APS) processing, which is comprised of first and second sheet-like cover members, each having a spine-adjacent edge, disposed in spaced, substantially parallel planes. A sheet-like spine interconnects the cover members along their spine-adjacent edges in such a fashion that a plurality of sheet-like photos can be interposed between the cover members and removably/replaceably secured to the spine by adhesive. A structural element is also provided on the second cover member to secure the APS photo cartridge associated with said photos.

In a preferred embodiment of the invention, the first and second cover members are arranged in such a way that a portion of the second cover extends beyond the free edge of the first cover. In this embodiment, the structural element used to secure the APS photo cartridge to the second cover member is comprised of a container member and adhesive between the container member and the cover extension.

In a highly preferred embodiment of the invention, the first cover member has a free edge away from the spine and the second cover member has a transverse cut parallel and adjacent to said free edge. This transverse cut separates the second cover member into a first part and a second part. These first and second parts define a parting line between them and are held together by at least one strip of tape that is placed over the parting line. In a preferred embodiment of this invention the tape is a single-stick tape that is perforated length wise along its central axis. In a highly preferred embodiment, the tape is a double-stick tape that is also perforated length wise along its central axis.

In yet another embodiment of the invention, the container member connects to the inner surface of the cover extension such that a portion of the cover extension extends beyond the container member, thereby forming a flap. This flap has a free edge away from the container member. A transverse crease extends along the cover extension at a distance from the free edge of the flap that is substantially equal to the distance between the transverse crease and the free edge of the first cover member. In a highly preferred embodiment, the flap has a hole formed therein and an adhesive thereon at a location away from the hole that allows the flap to adhere to the cover extension when the flap is folded over the container member. In yet another highly preferred embodiment of the invention, the adhesive on the flap is in the form of double-stick tape. In still another embodiment, the container is secured to the inner surface of the flap.

In an additional embodiment of the invention, the second cover member has a transverse demarcation line that is used to more easily form a crease at a first distance from its spine-adjacent edge. The free edge of the first cover is spaced from its spine-adjacent edge by a second distance which is substantially equal to the distance between the spine-adjacent edge and demarcation line of the second cover member. In a highly preferred embodiment of the invention, the demarcation line is a perforation. In yet another embodiment, single-stick tape is used to provide the adhesive and at least a portion of the single-stick tape extends over the perforation line, thereby reinforcing the perforation.

In a more preferred embodiment of the invention, the first and second sheet-like cover members each having a spine-adjacent edge are disposed in spaced, substantially parallel planes. A sheet-like spine interconnects the cover members along said spine-adjacent edges and a plurality of sheet-like photos are interposed between the cover members with such photos being removably and replaceably secured to the spine by adhesive. A sheet-like insert that is capable of being removably and replaceably secured to the spine is interposed between the cover members. Said insert has an index print attached to one of its sides and a structural element that secures a photo cartridge to the other.

In a more specific version of this embodiment, the second cover member includes a perforation outlining a geometric shape. In such version, the perforated geometric shape is in registry with the structural element that secures the photo cartridge to the insert and the structural element is comprised of a container member and adhesive between the container member and the insert.

In yet another version, the more preferred embodiment of the invention is used in combination with an auxiliary holder wherein the surface of the insert has a hole in it that allows the insert to be attached to the auxiliary holder In another preferred embodiment of the invention, each cover member has a free edge opposite its spine-adjacent edge. The free edges are spaced such that free edge of the second cover member extends beyond the free edge of the first cover member thereby forming a cover extension. In such embodiment, the cover extension and the first cover member each have an inner surface and an outer surface and a fastening structure is secured to the inner surface of the cover extension and to the outer surface of the first cover member in such a manner as to allow the inner surface of the cover extension to be attached against the outer surface of the first cover member.

In specific versions of this embodiment, the fastening structure may be comprised of any of the following: (a) interconnecting hook and loop surfaces; (b) double-stick tape; (c) magnetic tape; and (d) an interconnecting slot-and-tab arrangement.

BRIEF DESCRIPTION OF THE DRAWINGS

FIG. 14 is a perspective view of the photo/photo-cartridge delivery/storage packet for the Advanced Photo System showing the cover extension being folded back onto the cover member.

DETAILED DESCRIPTIONS OF THE PREFERRED EMBODIMENTS

Figure 1:
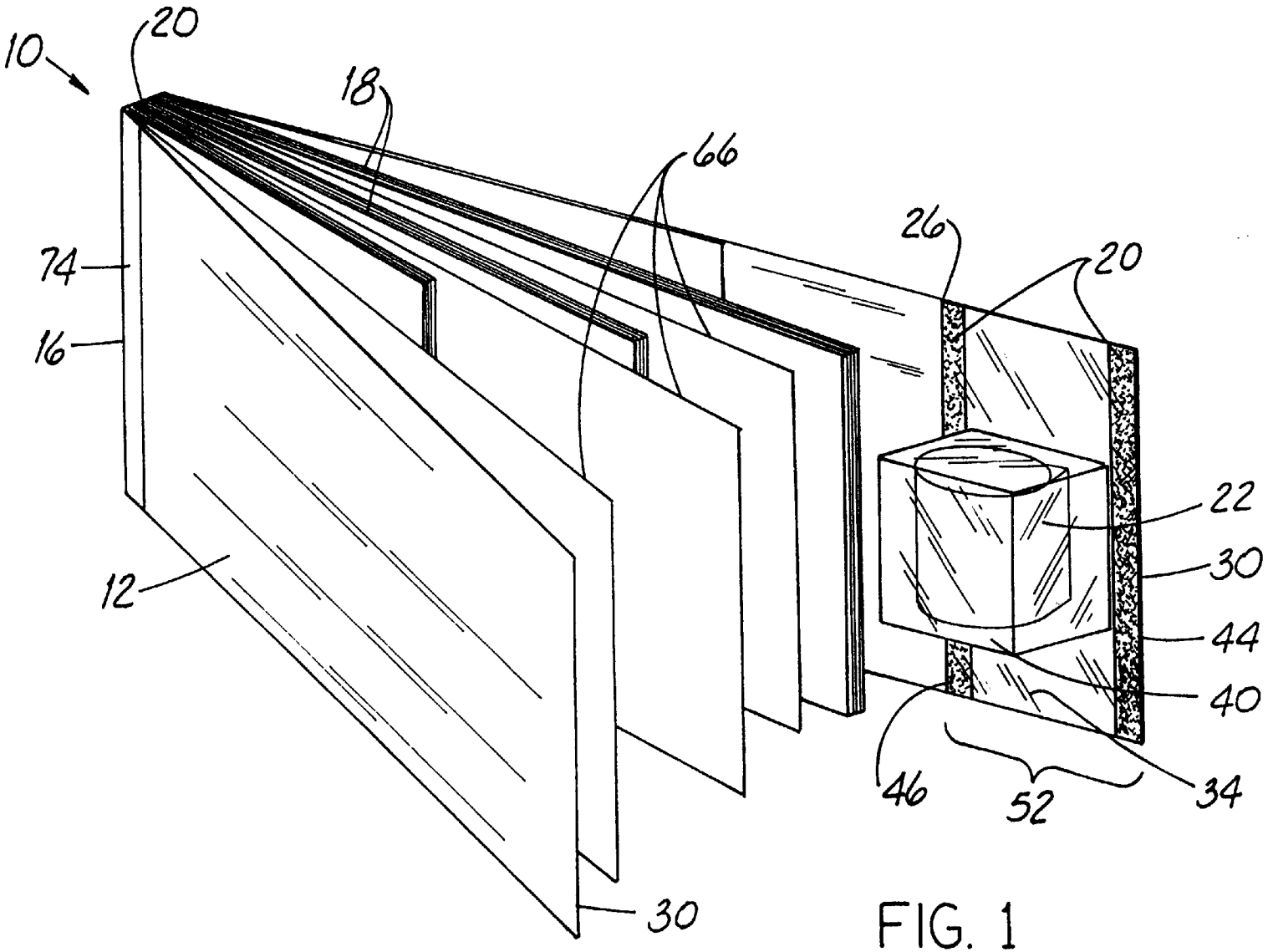
FIG. 1 is a perspective view of the photo/photo-cartridge delivery/storage packet for the Advanced Photo System showing bound photos of various lengths and the APS film cartridge secured to the cover extension.

FIGS. 1–12, 14, 19 and 20, show a photo/photo cartridge delivery/storage packet 10 for the products of Advanced Photo Systems (APS) processing. Such a packet includes a first and second sheet-like cover members 12, 14 disposed in spaced substantially parallel planes with each cover member 14, 16 having a spine-adjacent edge 16. A sheet-like spine 74 joins the cover members together by interconnecting with each of them along their spine-adjacent edges 16. A plurality of sheet-like photos 18 are interposed between the cover members 14, 16 and removably/replaceably secured to the spine 74 by adhesive 20. These photos 18 may be of the same or various lengths. When photos 18 of differing lengths are secured to the spine 74, dividers 66 are used to separate the various sizes. The packet 10 also includes a means on the second cover member 14 for securing thereto the APS photo cartridge 22 associated with the photos 18 as well as an attachment on the inside of one of the covers for storing an APS index print 24.

Figure 2:
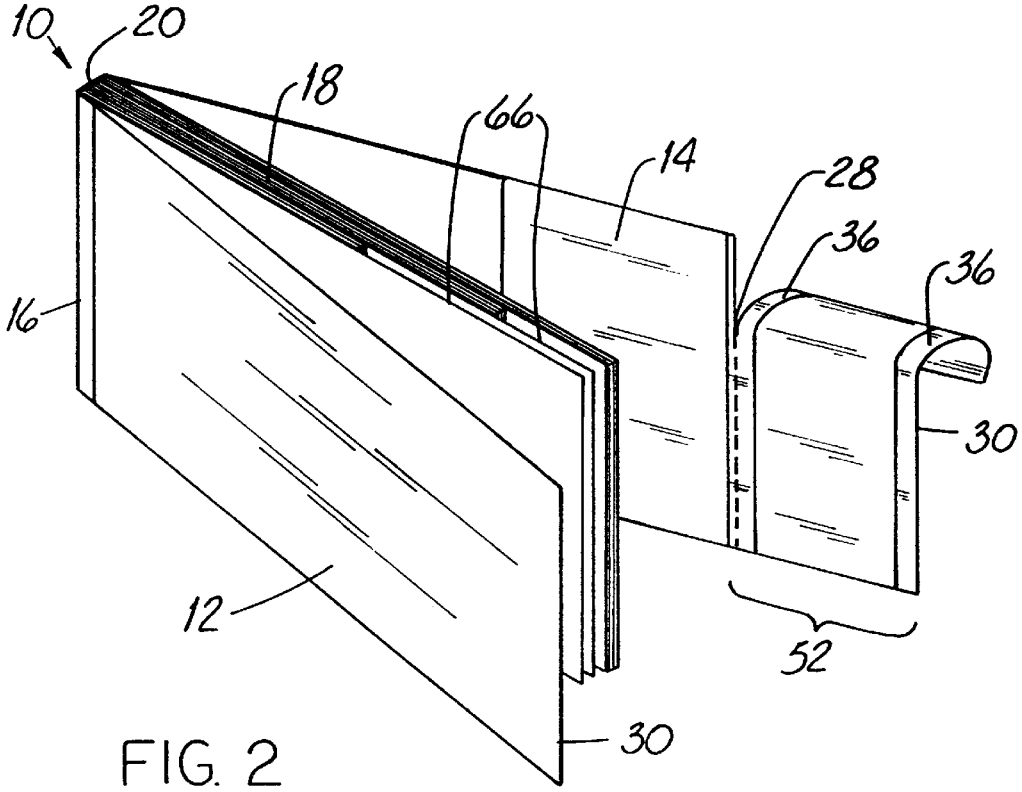
FIG. 2 is a perspective view of the photo/photo-cartridge delivery/storage packet for the Advanced Photo System showing an index print attached to the second cover and double-stick tape attached to the cover extension to secure the APS film cartridge housed in a pouch to the packet.

FIG. 1, shows a preferred embodiment of the invention, in which the second cover member 14 has a transverse demarcation line 26 that is used to facilitate a crease in the second cover. This demarcation line 26, which involves a substantially continuous partial-depth surface cutting, a full surface cutting, an indentation, or perforation 28, as shown in FIG. 2, is at a distance from the spine-adjacent edge 16 of the second cover member 14 which is substantially equal to the distance between the spine-adjacent 16 and free edges 30 of the first cover member 12. That is, the line 26 is parallel and adjacent to the free edge 30 of the first cover member 12. In a highly preferred embodiment, the perforation 28 is reinforced by a strip of double-stick tape 36 that does not interfere with tearing along the perforation 28; it has been found that an appropriate choice of tape 36 will prevent accidental weakening and detachment while having no negative effect on deliberate tearing.

Figure 7:
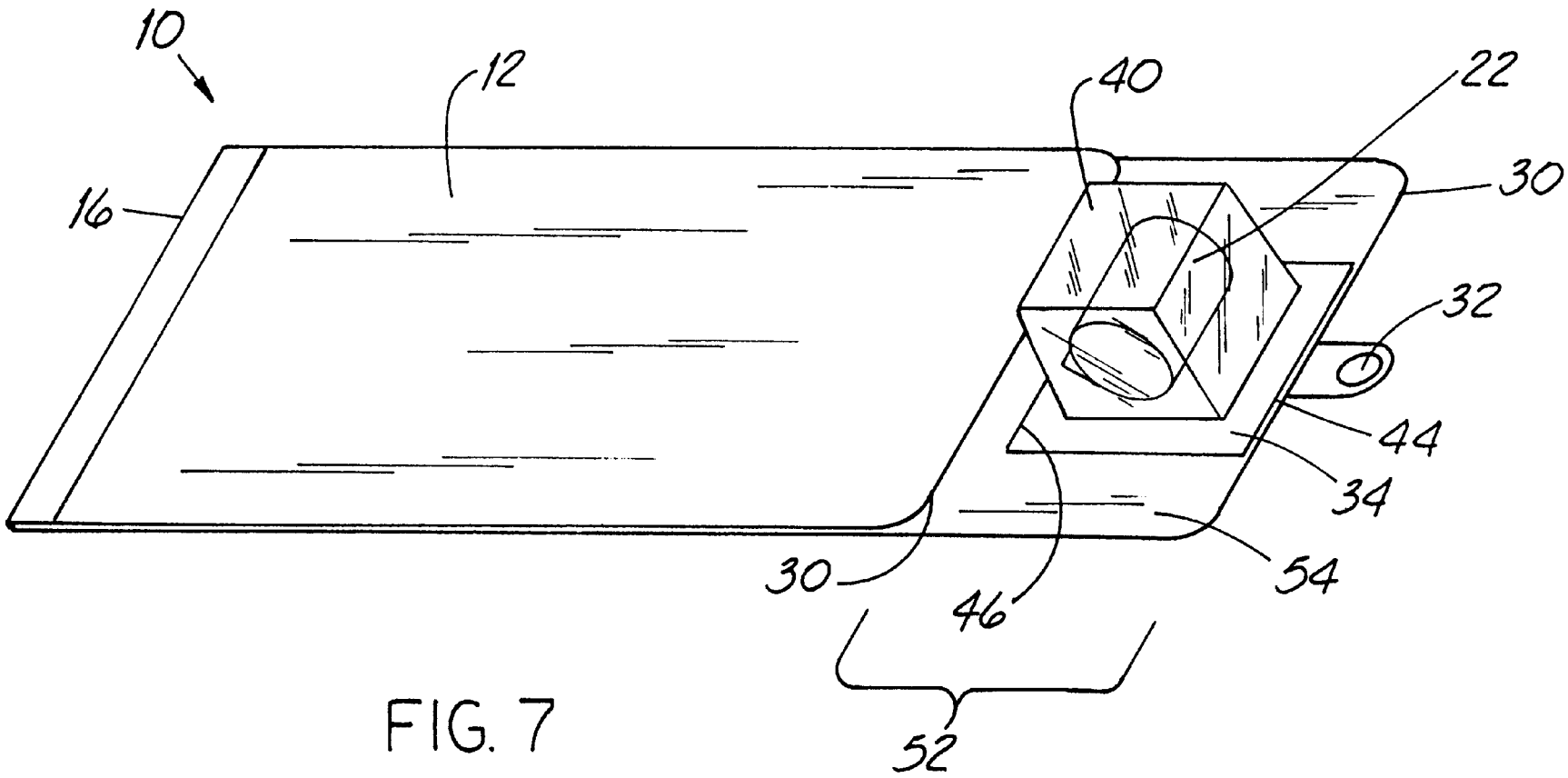
FIG. 7 is a perspective view of the photo/photo-cartridge delivery/storage packet for the Advanced Photo System showing an attachment that allows the packet to be hung on a display or storage rod.

FIG. 7, shows yet another preferred embodiment, in which the second cover member 14 includes an opening 32 which is used to facilitate the hanging of the packet 10 on a rod.

Figure 19:
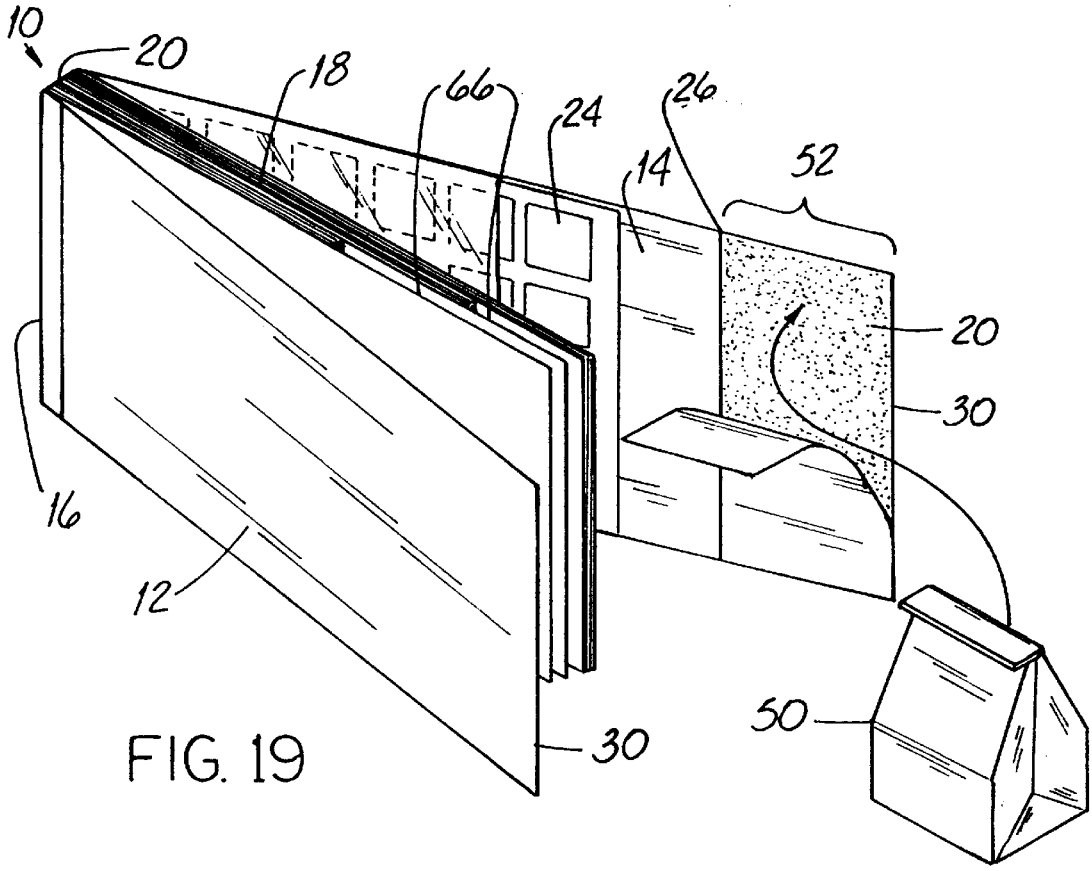
FIG. 19 is a perspective view of the photo/photo-cartridge delivery/storage packet for the Advanced Photo System showing and index print inserted in the packet, and double-stick tape attached to the cover extension for the securing of the APS pouch.
Figure 5:
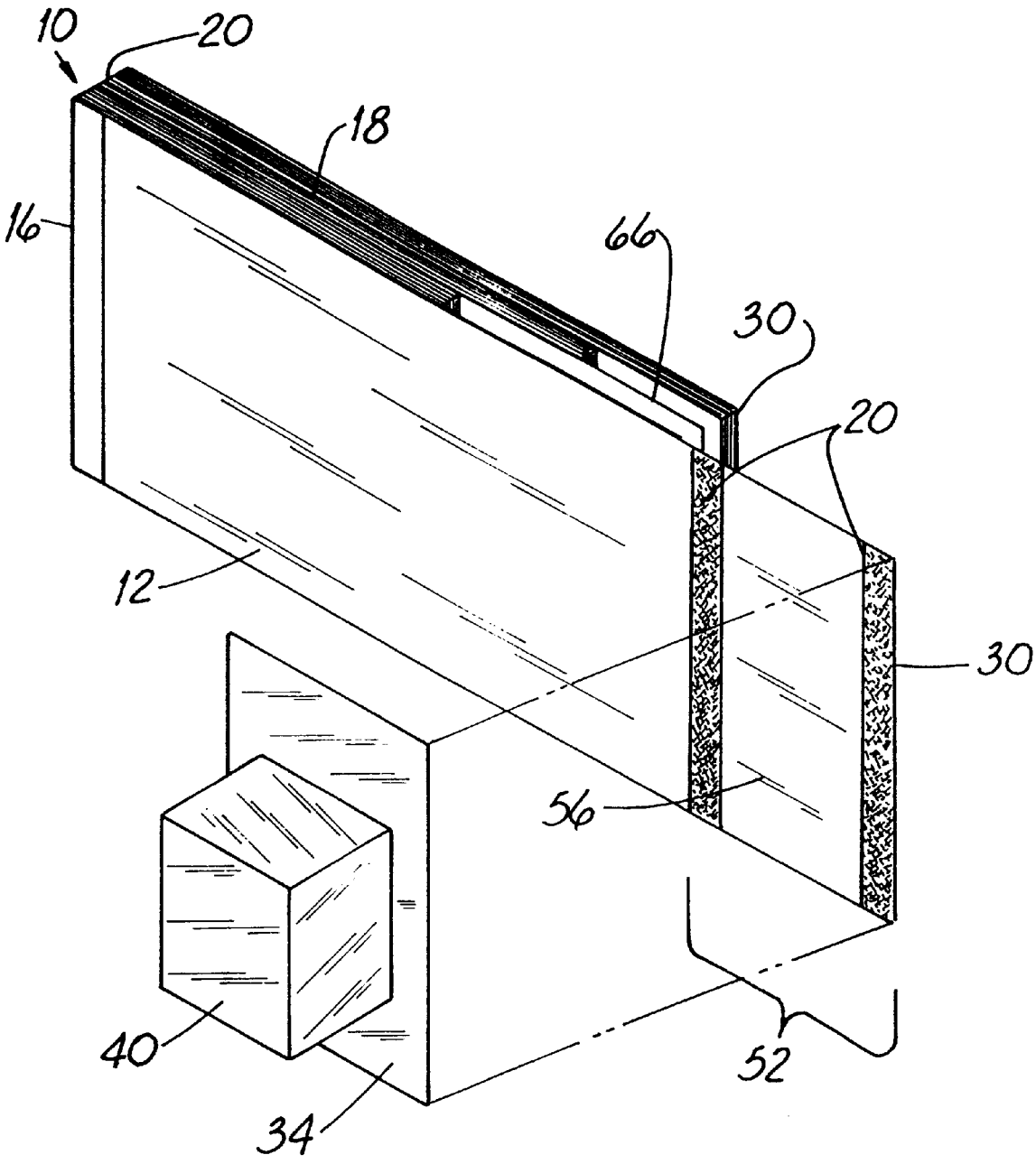
FIG. 5 is a perspective view of the photo/photo-cartridge delivery/storage packet for the Advanced Photo System showing a blister member attached to the first side of the cover extension where the double-stick tape remains attached to the cover extension when the blister member is removed from the cover.
Figure 6:
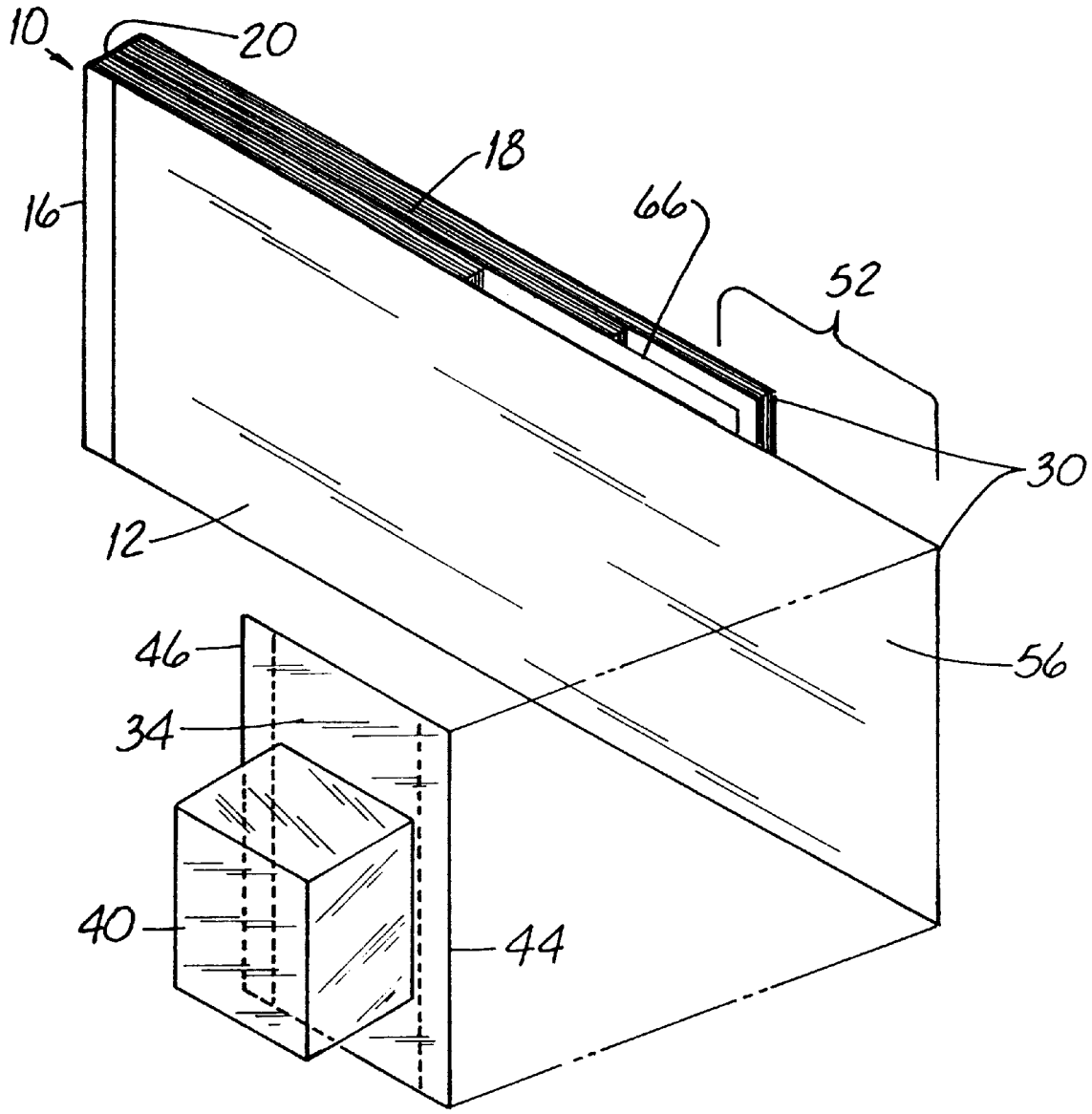
FIG. 6 is a perspective view of the photo/photo-cartridge delivery/storage packet for the Advanced Photo System showing a blister member attached to the first side of the cover extension where the double-stick tape remains attached to the blister member when the blister member is removed from the cover.

As shown in FIG. 5, 6 and 19, the invention secures the APS photo cartridge 22 to the packet 10 by the use of a container member 34 and adhesive 20 between the container member 34 and the second cover member 14. In a preferred embodiment, a double-stick tape 36 is used to provide the adhesive 20, thereby facilitating attachment of the container member 34 during assembly of the packet 10. In a highly preferred embodiment, the double-stick tape 36 has adhesive of higher adhesiveness on one side 68 than on the other. This differential in adhesiveness 20 determines whether or not the double-stick tape 36 will be removed from the second cover member 14 upon removal of the container member 34 as shown in FIG. 6, or whether it will remain on the second cover member 14 as shown in FIG. 5.

Figure 18:
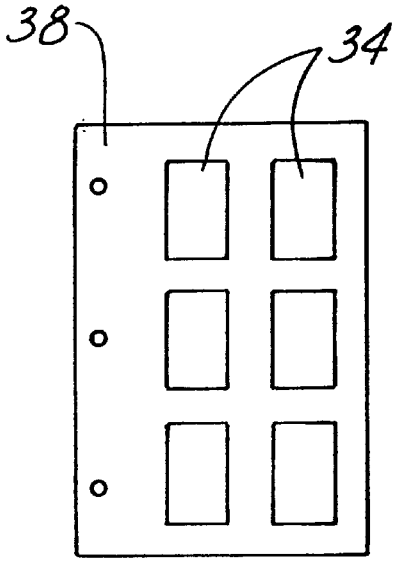
FIG. 18 is a top view of a storage sheet with blister packs attached to it.

FIG. 6, shows yet another highly preferred embodiment in which the higher-adhesiveness side 68 of the double-stick tape 36 is adhering to the container member 34, thereby facilitating removal of the container member 34 from the second cover member 14 in a manner allowing ready attachment to a storage surface 38 such as a page, either transparent or opaque, capable of being secured in a 3-ring binder, as shown in FIG. 18.

Figure 10:
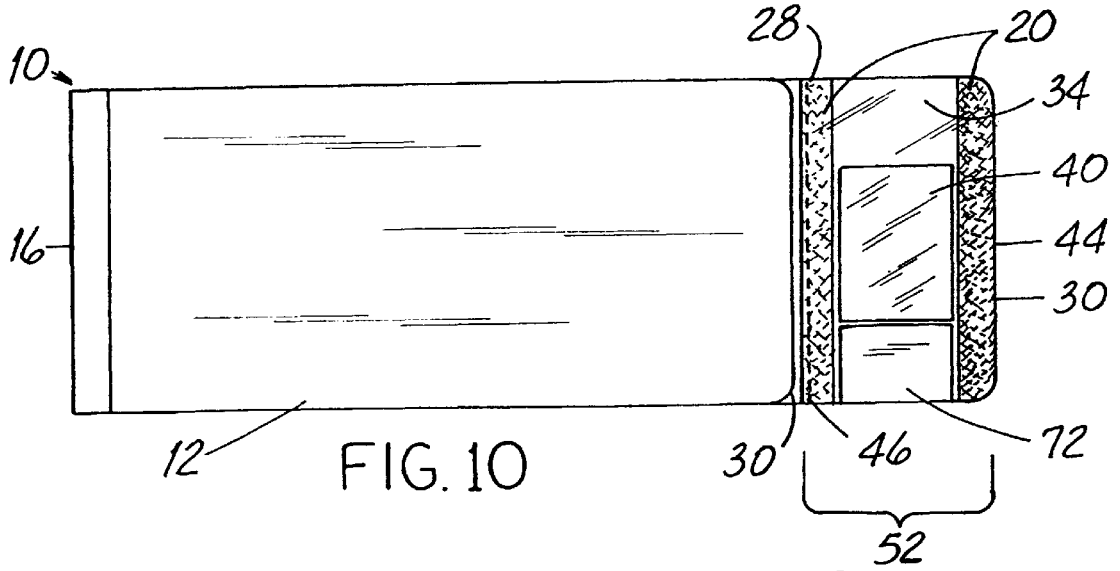
FIG. 10 is a top view of the photo/photo-cartridge delivery/storage packet for the Advanced Photo System showing the blister member having a notch cut in the bottom to allow film data to be written on the cover extension.

FIGS. 1, and 3–12, show a preferred embodiment of the invention in which the container member 34 used to secure the APS photo cartridge 22 to the packet 10 comprises a blister member 40, whereby a portion of the second cover member 14 and the blister member 40 together form a blister pack 42 providing a container 34 for the cartridge. In this embodiment, the blister member 40 can fully cover the second cover member 14 or, a portion of the blister member 40 can be cut out, as shown in FIG. 10, so as to allow the user to write information concerning the subject matter of the film such as the date, time, and place of exposure on the second cover member 14.

Figure 8:
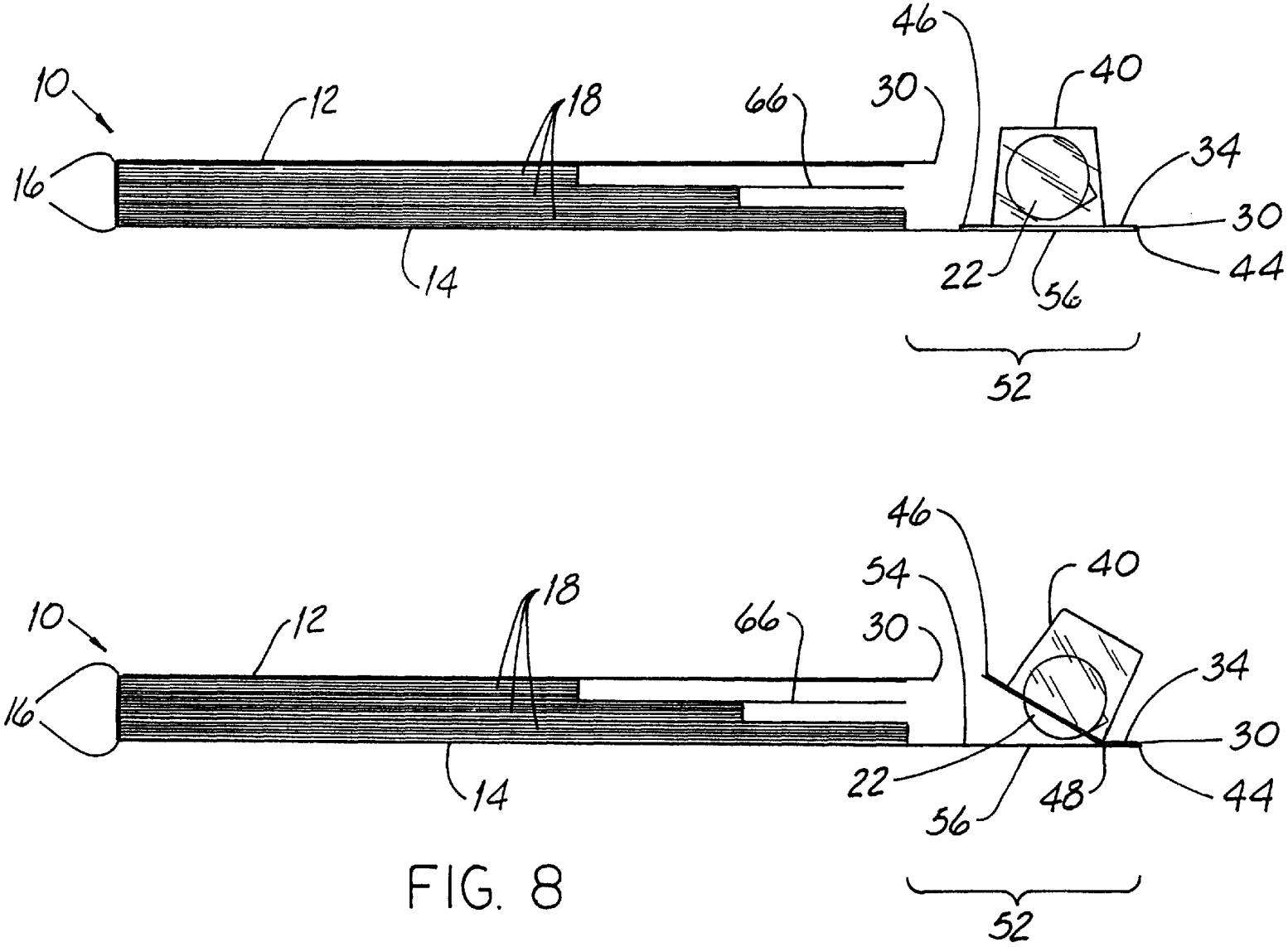
FIG. 8 is an elevation view of the photo/photo-cartridge delivery/storage packet for the Advanced Photo System showing the hinge feature of the blister member.
Figure 9:
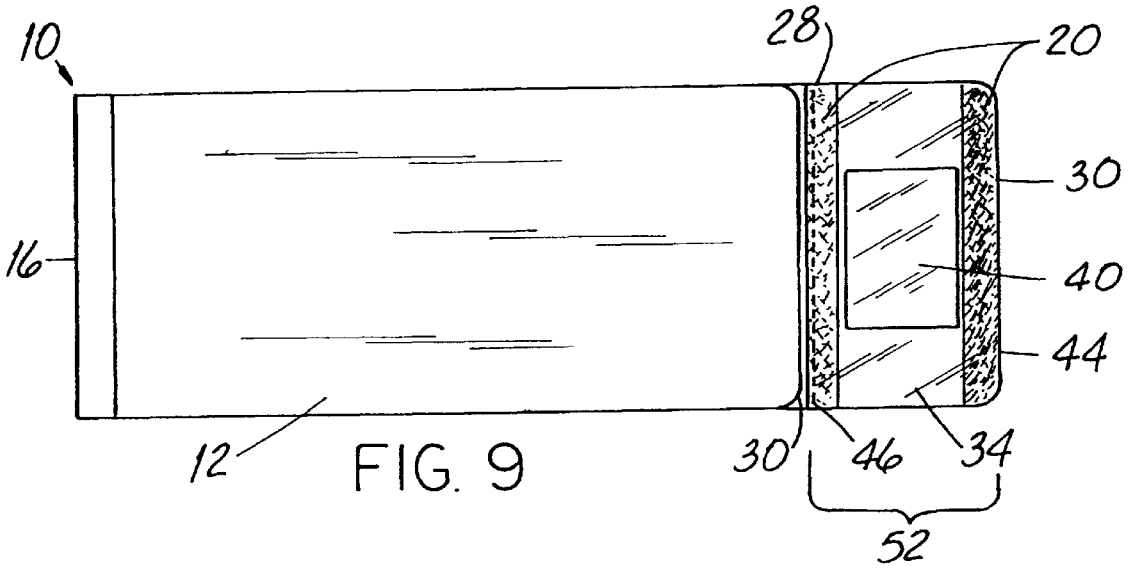
FIG. 9 is a top view of the photo/photo-cartridge delivery/storage packet for the Advanced Photo System showing the blister member completely covering the cover extension.

Also in this embodiment, the blister member 40 includes opposed first and second edge portions 44, 46 which adhere to the second cover member 14. In a highly preferred embodiment, as shown in FIG. 8, the adhesive includes adhesive of higher adhesiveness along the first edge portion 44, and adhesive of lower adhesiveness along the second edge portion 46 such that the first edge portion 44 functions as a hinge 48 when only the first edge portion 44 is adhering to the second cover member 14, thereby facilitating the opening and closing of the container 34 for removal and reinsertion of the cartridge 22.

In yet another embodiment of the invention, as shown in FIG. 19, the container member 34 used to secure the APS photo cartridge 22 to the packet 10 involves the use of a pouch 50. Such pouch 50 may be of either substantially transparent material or opaque material.

FIGS. 1–11, 14, 19 and 20, show a highly preferred embodiment of the invention, where each cover member 12, 14 has a free edge 30 opposite its spine-adjacent edge 16 and the free edge 30 of the second cover member 14 is farther from its spine-adjacent edge 16 than is the free edge 30 of the first cover member 12 from its spine-adjacent edge 16, thereby forming a cover extension 52. In this embodiment, the cover extension 52 provides the surface to which the APS photo cartridge 22 is secured by use of the various techniques described above. Also in this embodiment, the second cover 14 is demarcated, as described above, whereby the demarcation line 26 is parallel to the free edge 30 of the first cover member 12. In a specific version of this embodiment, as shown in FIG. 2, the demarcation, which involves a substantially continuous partial-depth surface cutting, full surface cutting, an indentation or perforation 28, may be reinforced with double-stick tape 36, i.e., tape 36 having adhesive on both sides. This double-stick tape 36 both reinforces the flap created by the cover extension 52 and adheres the blister bubble 40 or blister card 62 to the cover surface.

Figure 11:
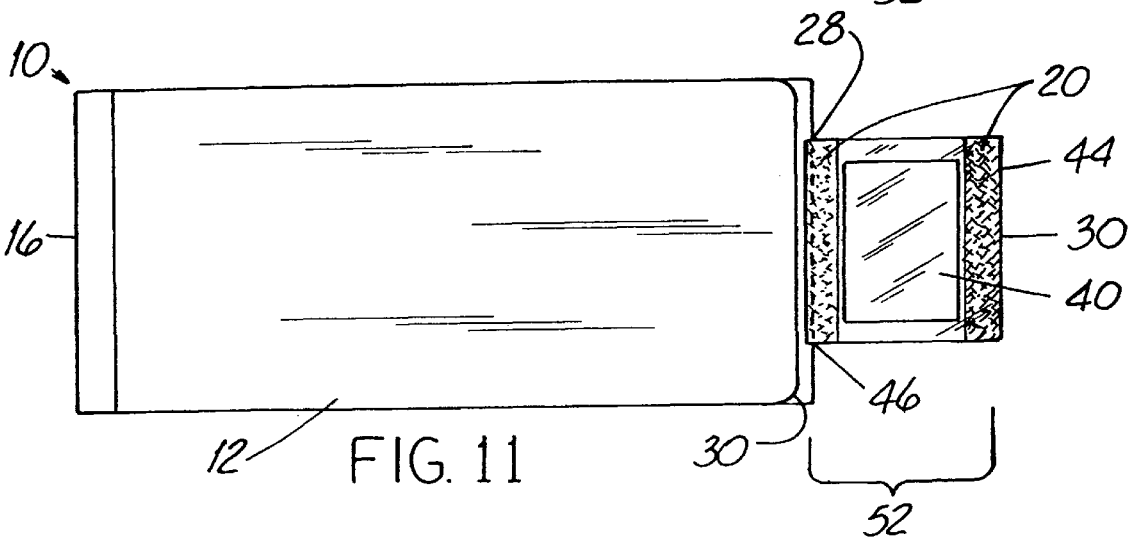
FIG. 11 is a top view of the photo/photo-cartridge delivery/storage packet for the Advanced Photo System showing the blister member attached to a cover extension that is narrower than the cover member.
Figure 12:
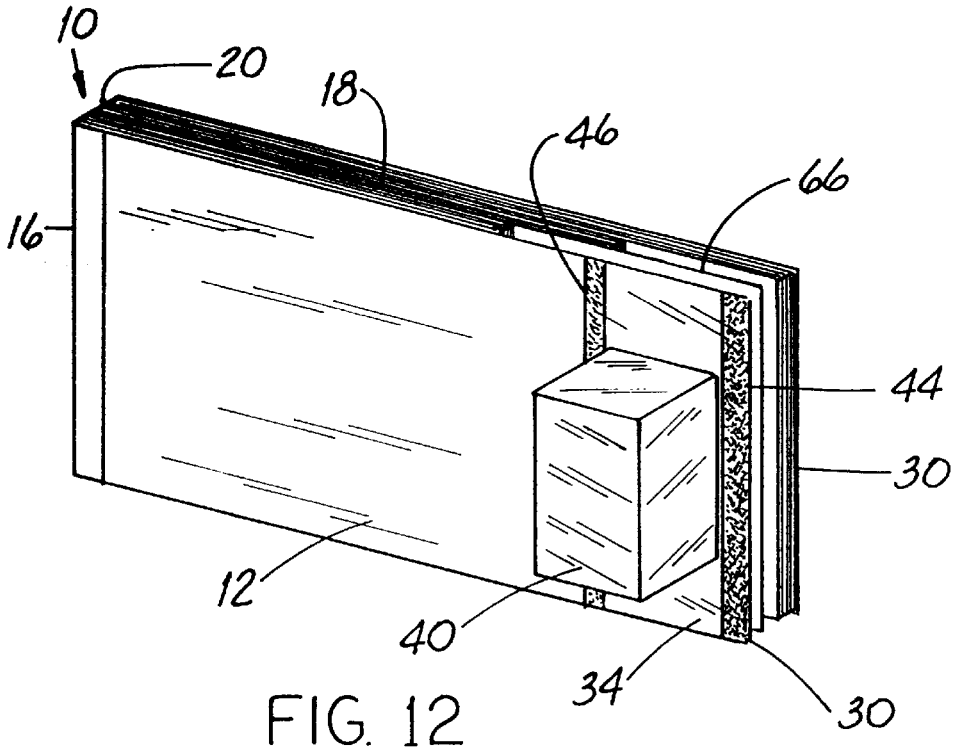
FIG. 12 is a perspective view of the photo/photo-cartridge delivery/storage packet for the Advanced Photo System showing the APS film cartridge attached to the cover member.

In yet another highly preferred embodiment, as shown in FIG. 14, the adhesive 20 and the surfaces of the cover extension 52 and container member 34 that the adhesive 20 joins together are such that the removal of the container member 34 leaves the adhesive 20 on the cover extension 52. This allows for the cover extension 52 to be used as a flap to fold over the free edge 30 of the first cover member 12 and adhere thereto or to fold back onto and adhere to the second cover member 14. In a more specific version of such embodiment, as shown in FIGS. 4 and 11, the cover extension 52 is narrower than the remainder of the second cover member 14.

Figure 3:
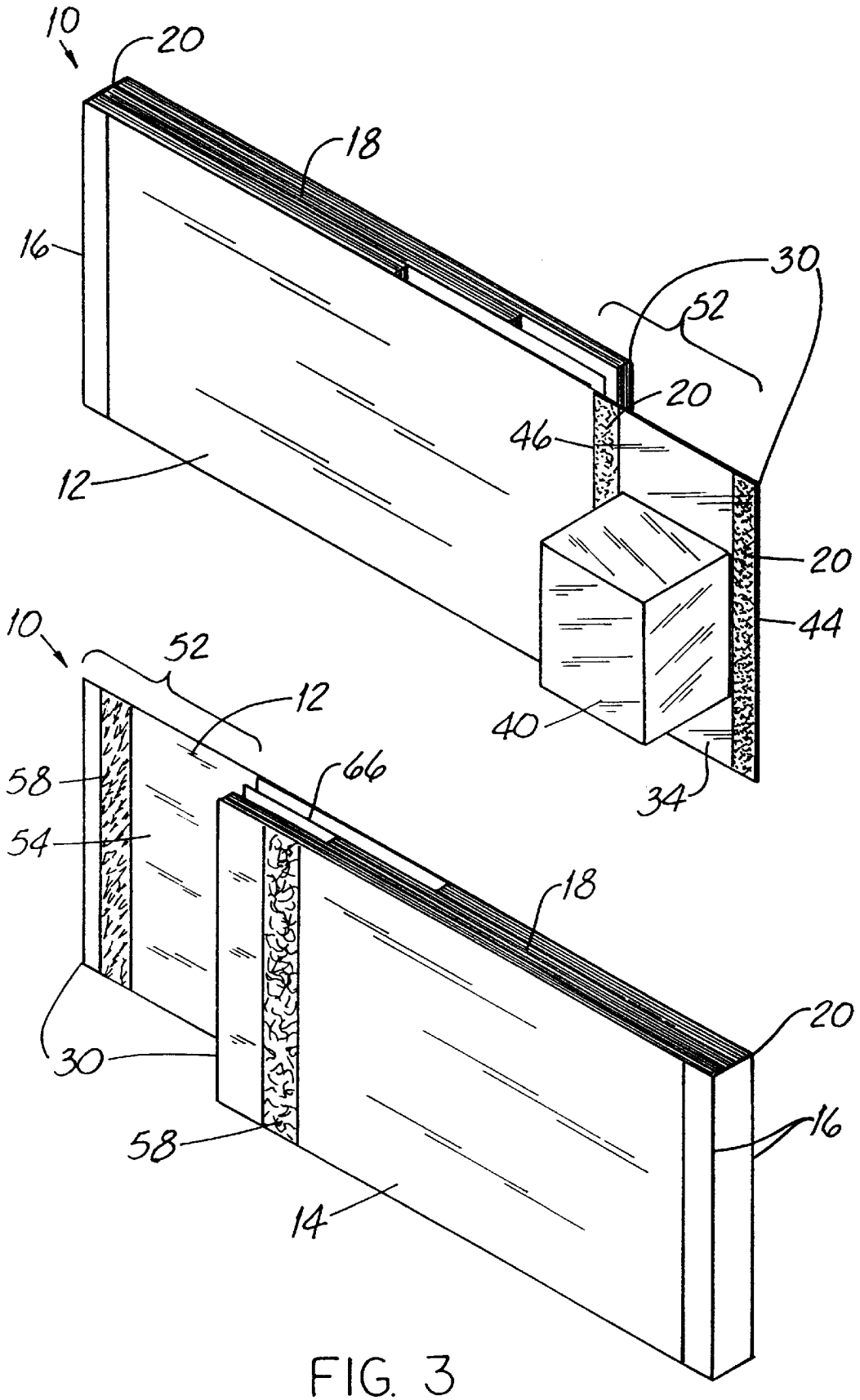
FIG. 3 is a perspective view of the photo/photo-cartridge delivery/storage packet for the Advanced Photo System showing a blister member attached to the first side of the cover extension and a fastening means on the opposite side capable of locking with the fastening means on the second cover.
Figure 4:
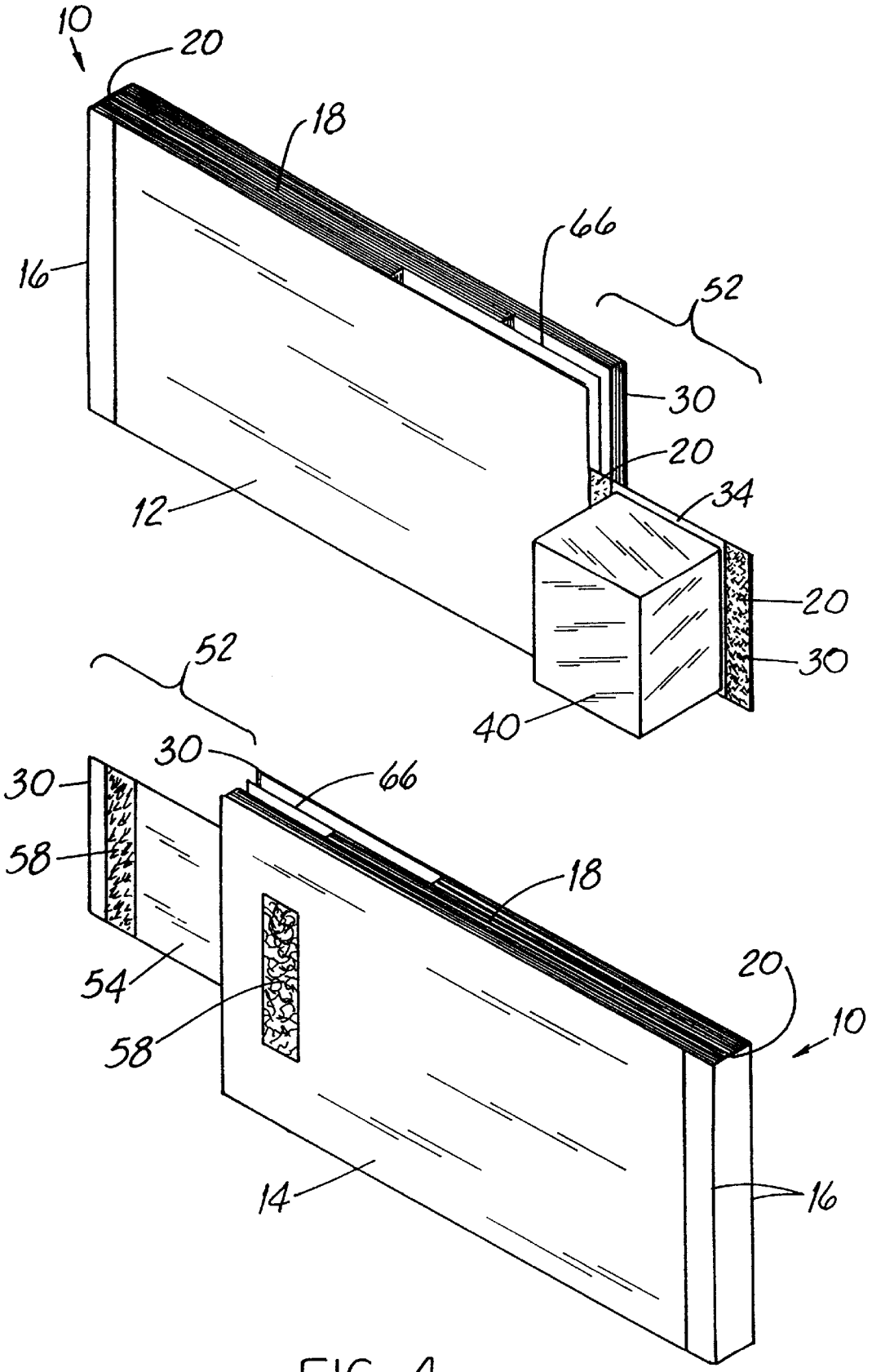
FIG. 4 is a perspective view of the photo/photo-cartridge delivery/storage packet for the Advanced Photo System showing a blister member attached to the first side of the cover extension, where the cover extension is narrower than the second cover member, and a fastening means on the opposite side capable of locking with the fastening means on the second cover.

FIGS. 3 and 4, show still another highly preferred embodiment of this invention where the cover extension 52 and the first cover member 12 each have an inner surface 54 and an outer surface 56, the container member 34 is secured to the outer surface 56 of the cover extension 52, and a fastening means 58 is secured to the inner surface 54 of the cover extension 52 and to the outer surface 56 of the first cover member 12 whereby the inner surface 54 of the cover extension 52 is attached against the outer surface 56 of the first cover member 12. In an additional version of this embodiment, as shown in FIG. 20, the container member 34 is secured to the inner surface 54 of the cover extension 52, and a fastening means 58 is secured to the inner surface 54 of the cover extension 52 and to the outer surface 56 of the first cover member 12.

Figure 13:
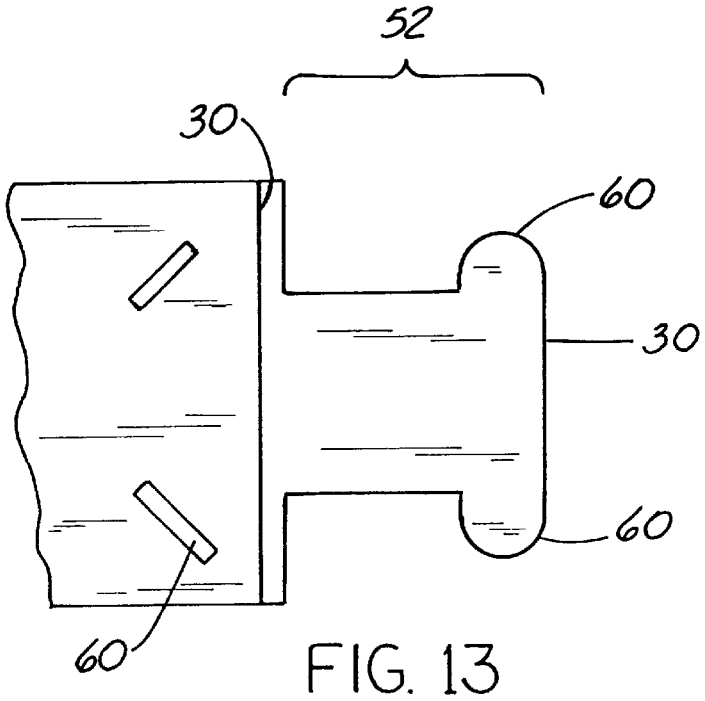
FIG. 13 is a cut away view of the tab-and-slot fastening means.
Figure 15A:
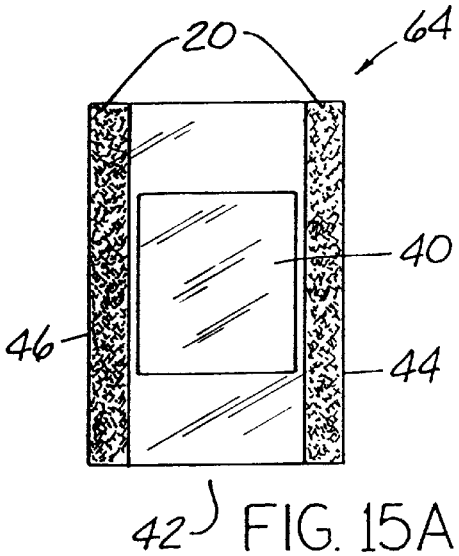
FIG. 15(A) is a top view of the blister card showing the double-stick tape between the blister member and the card member.
Figure 15B:
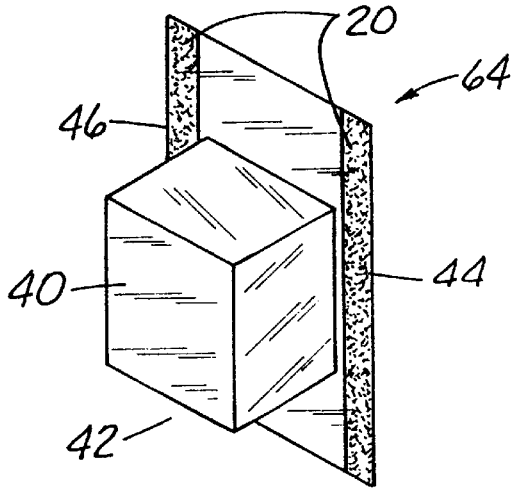
FIG. 15(B) is a perspective view of the blister card.
Figure 15C:
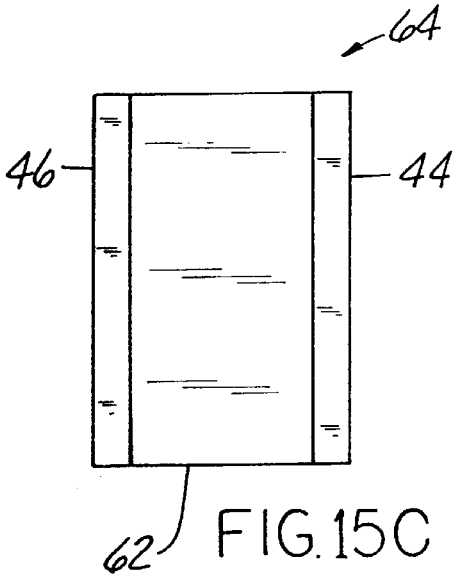
FIG. 15(C) is a back view of the blister card showing the liner attached to the double-stick tape.
Figure 15D:
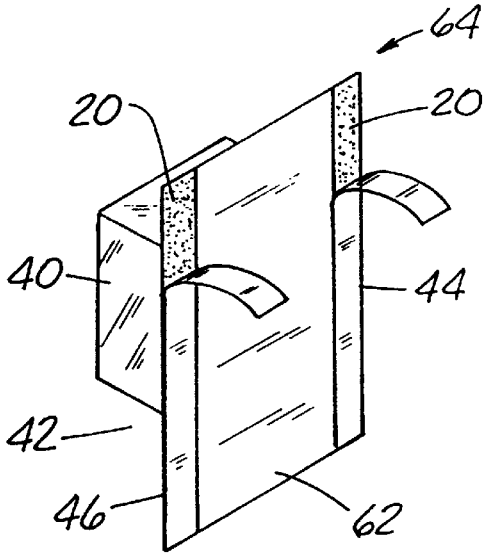
FIG. 15(D) is a perspective view of the blister card showing the double-stick tape attached to the back of the card.
Figure 15E:
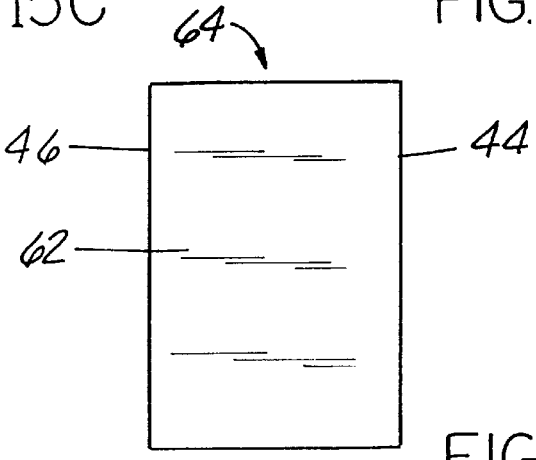
FIG. 15(E) is a top view of the blister card showing the double-stick tape between the blister member and the card member.
Figure 16:
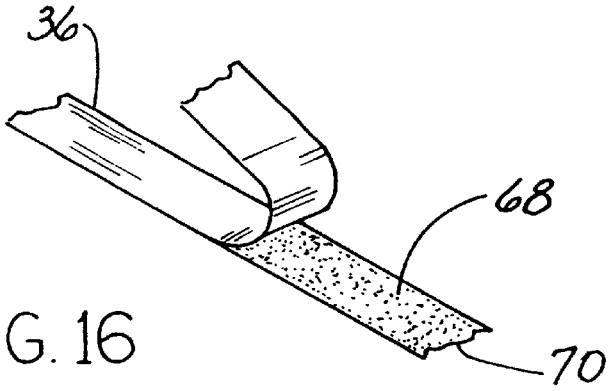
FIG. 16 is a perspective of a double-stick strip of tape.
Figure 17:
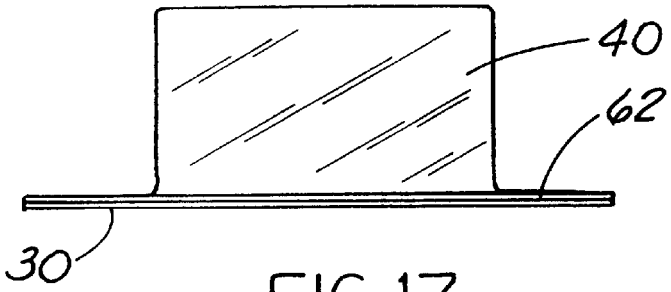
FIG. 17 is a is side elevation of the blister card showing the blister member attached to the blister card which is attached to the cover member.
Figure 20:
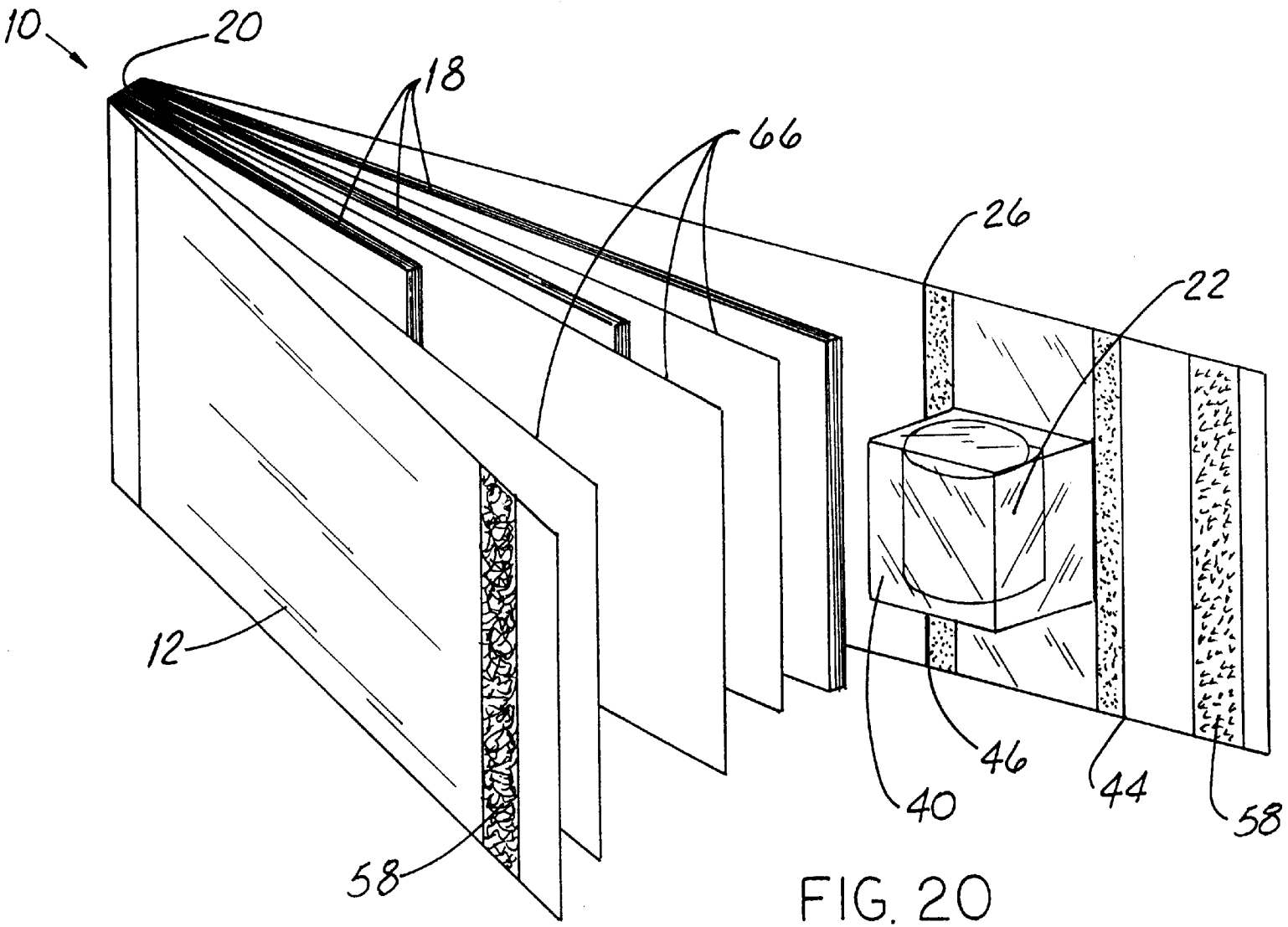
FIG. 20 is a perspective view of the photo/photo-cartridge delivery/storage packet for the Advanced Photo System showing a blister member and fastening means attached to the first side of the cover extension capable of locking with the fastening means on the second cover.
Figure 21:
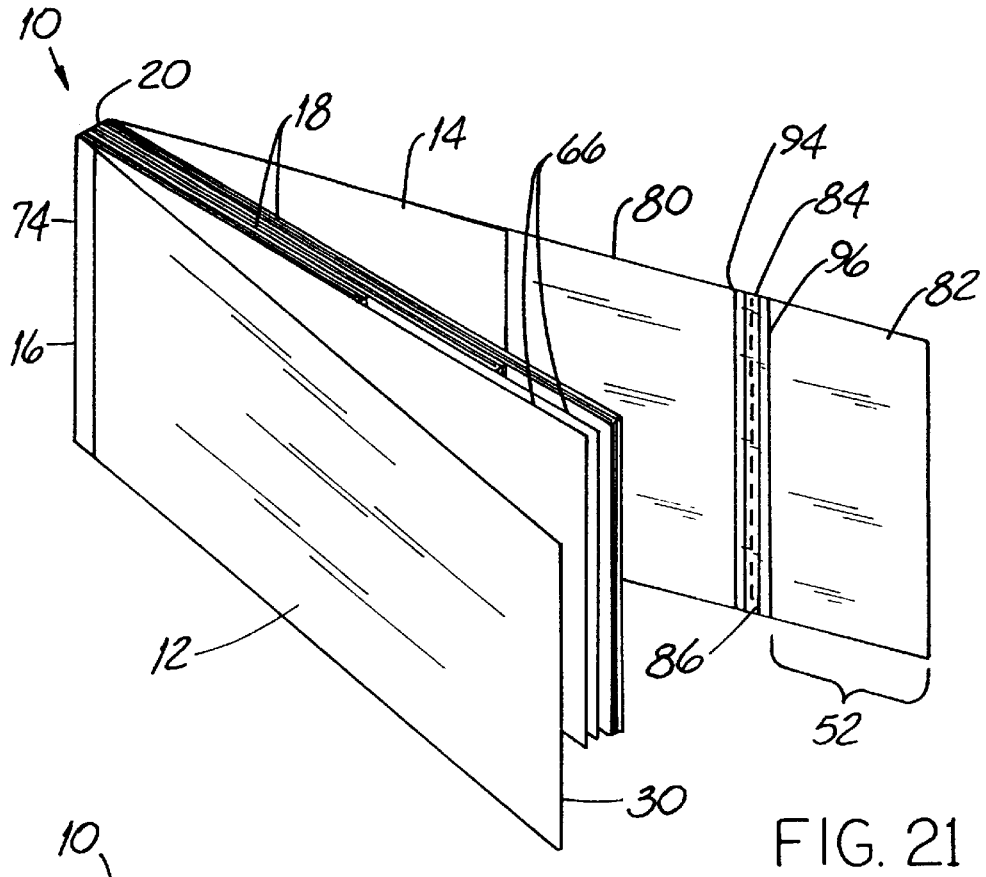
FIG. 21 is a perspective view of the photo/photo-cartridge delivery/storage packet for the Advanced Photo System showing the cover extension cut away from the second cover and the second cover and cover extension held together with single-sided tape.
Figure 22:
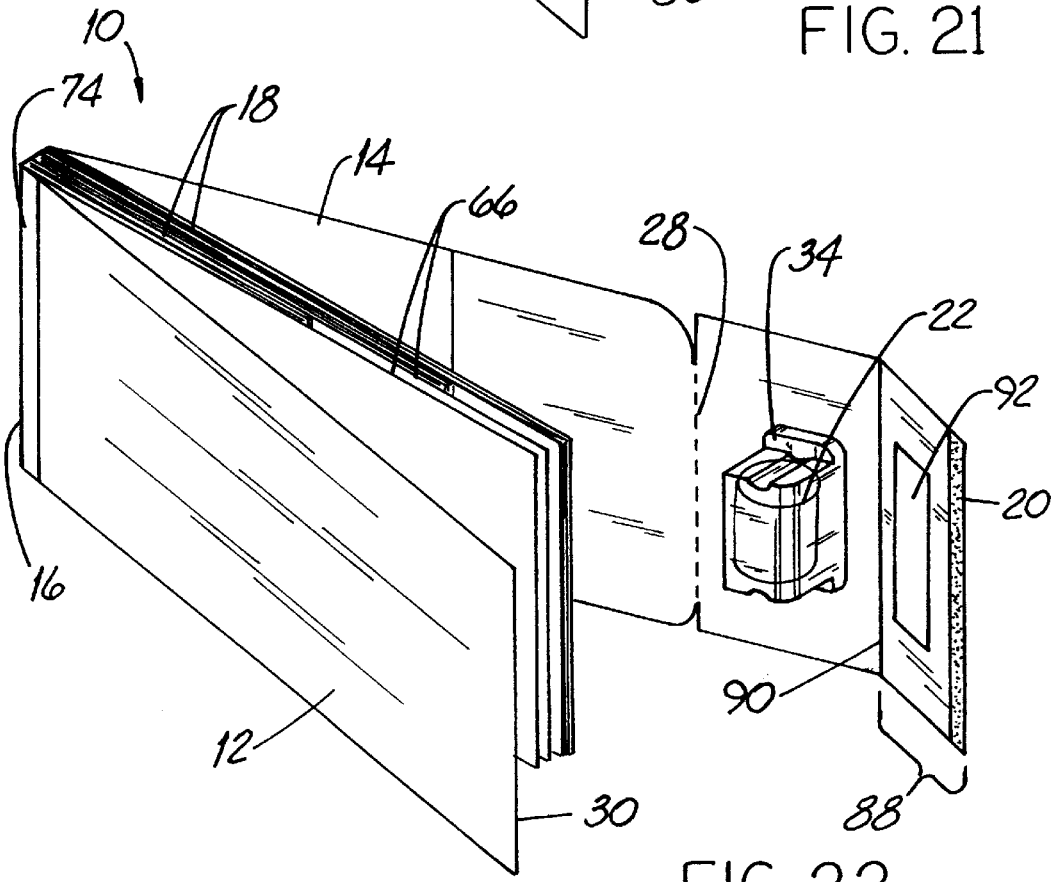
FIG. 22 is a perspective view of the photo/photo-cartridge delivery/storage packet for the Advanced Photo System showing a flap attached to the cover extension where said flap is used to trap the photo cartridge to the cover extension.
Figure 23:
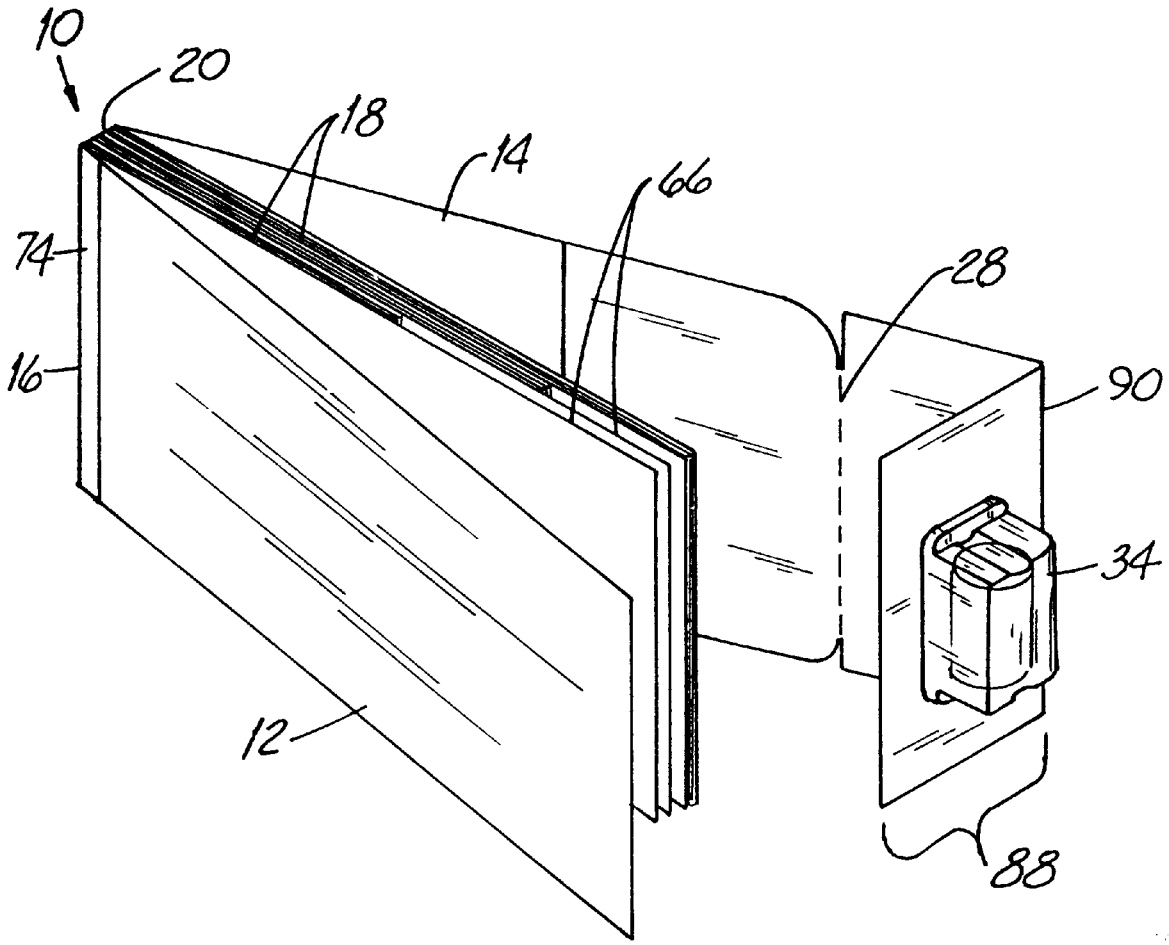
FIG. 23 is a perspective view of the photo/photo-cartridge delivery/storage packet for the Advanced Photo System showing the film cartridge container secured to the flap that is attached to the cover extension.

In a specific version of this embodiment, the fastening means 58, shown in FIGS. 3, 4, and 20, comprise interconnecting hook and loop surfaces. In a more specific version of this embodiment, the fastening means 58 comprises double-stick tape 36. In still another version of the embodiment, the fastening means comprises magnetic tape, while in yet another version of the embodiment, the fastening means comprises an interconnecting slot-and-tab arrangement 60, as shown in FIG. 13.

FIGS. 15(*a*)–(*e*) show another version of a highly preferred embodiment of the invention in which the securing means comprises a card member 62, a container member 34 attached to the card member 62 to form a container for the cartridge 22, and an adhesive 20 between the container and the cover extension 52. In this embodiment, the adhesive 20 comprises double-stick tape 36 between the card member 62 and cover extension 52, as shown in FIG. 15(*d*) and the container member 34 comprises a blister member 40, whereby the container is a blister pack formed of the card member 62 and the blister member 34 together.

In a more specific embodiment, the blister member 34 includes opposed first and second edge 44, 46 portions which adhere to the card member 62. And, in yet another more specific embodiment, a second adhesive and a third adhesive secure the first and second edge portions 44, 46, respectively, to the card member 62. In this embodiment, the second adhesive has a higher adhesiveness than the third adhesive such that the first edge portion 44 functions as a hinge 48, as shown in FIG. 8, when only the first edge portion 44 is adhering to the card member 62, thereby facilitating opening and closing of the container for removal and reinsertion of the cartridge 22.

An additional embodiment of the invention involves an improved packet for storing photo-related products. Specific features of such embodiment are particularly useful for mounting photos and storing a photo cartridge in what has come to be known in the industry as the Advanced Photo System (APS). But after appreciating the specification, it will be apparent that the new packet may be used with other types of photos and photo cartridges.

In this embodiment, the packet has first and second sheet-like cover members 12, 14, each having a spine-adjacent edge 16, disposed in spaced, substantially parallel planes. A flat, adhesive-bearing spine 74 (made, for example, of tape with adhesive along one surface) interconnects the cover members 12, 14 along their spine-adjacent edges 16 in such a fashion that a plurality of sheet-like photos 18 can be interposed between the cover members 12, 14 and removably and replaceably secured to the exposed adhesive 20 along the spine 74. A structural element is also provided on the second cover member 14 to secure a photo cartridge 22, e.g., an APS cartridge, associated with the photos 18. (As used herein, the phrase "removably and replaceably secured" and like phrases means that the adhesive 20 along the spine 74 is of such a nature that the edges of photos 18 adhere to it, can be pulled away from it and again urged against such adhesive 20 for photo 18 retention.)

Preferably, the first and second cover members 12, 14 are arranged in such a way that a portion of the second cover 14 extends beyond the free edge 30 of the first cover 12. In this embodiment, the structural element used to secure the APS photo cartridge 22 to the second cover member 14 includes a container member 34 and adhesive 20 between such member 34 and the cover extension 52 to hold the member 34 in place.

The first cover member 12 has a free edge 30 away from the spine 74 and the second cover member 14 has a transverse cut parallel and adjacent to said free edge 30. This transverse cut separates the second cover member 14 into a first part 80 and a second part 82. These first and second parts 80, 82 define a parting line 84 between them and are held together by at least one strip of tape 86 that is placed over the parting line 84, the first edge 94 of the first part 80, and the first edge 96 of the second part 82. In a preferred embodiment of this invention, the tape is a single-stick tape (i.e., tape having adhesive along only one of its two surfaces) that is perforated length wise along its central axis. Such tape is commonly known as "skip-and-slip" within the tape industry. In another preferred embodiment, the tape is a double-stick tape that is also perforated length wise along its central axis.

In yet another embodiment of the invention, the container member 34 is secured to the inner surface 54 of the cover extension 52 such that a portion of the cover extension 52 extends beyond the container member 34, thereby forming a flap 88. This flap 88 has a free edge 30 away from the container member 34. A transverse crease 90 extends along the cover extension 52 and the distance between the transverse crease 90 and the free edge 30 of the flap 88 is substantially equal to the distance between the transverse crease 90 and the free edge 30 of the first cover member 12. The flap 88 has a hole 92 formed therein and an adhesive 20 thereon at a location away from the hole 92 that allows the flap 88 to adhere to the cover extension 52 when the flap 88 is folded over the container member 34. In a highly preferred embodiment of the invention, the adhesive 20 on the flap 88 is in the form of double-stick tape. In still another embodiment, the container 34 is secured to the inner surface 54 of the flap 88.

In another aspect of the invention, the second cover member 14 has a transverse demarcation line 26 that is used to facilitate a crease at a first distance from its spine-adjacent edge 16. The free edge 30 of the first cover 12 is spaced from its spine-adjacent edge 16 by a second distance which is substantially equal to the distance between the spine-adjacent edge 16 and demarcation line 26 of the second cover member 14. In one specific embodiment, the demarcation line 26 is a perforation 28. Single-stick tape 86 is used to provide the adhesive 20 and at least a portion of the single-stick tape 86 extends over and along either side of the perforation line 28, thereby reinforcing the perforation 28.

Figure 24:
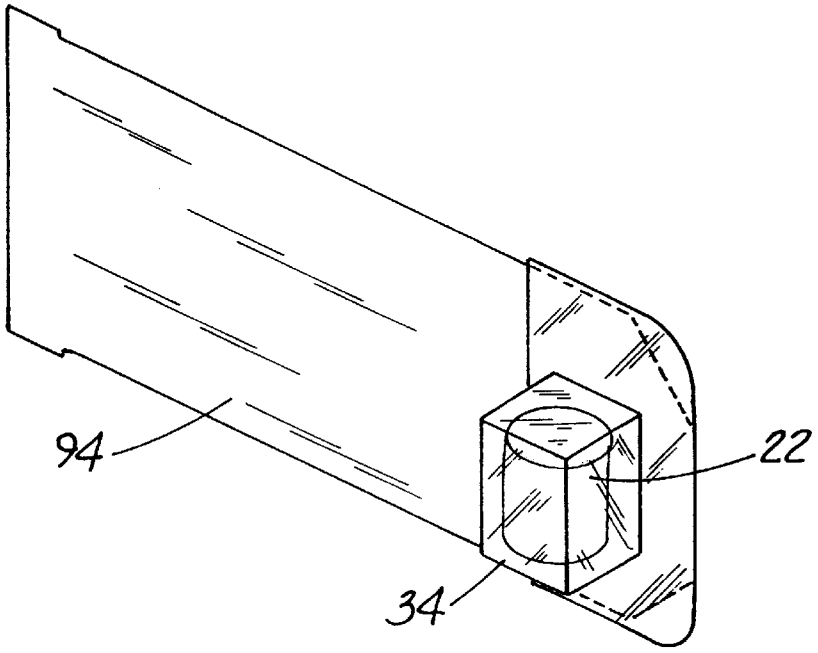
FIG. 24 is a perspective view of the insert card showing the APS container attached to one side.
Figure 25:
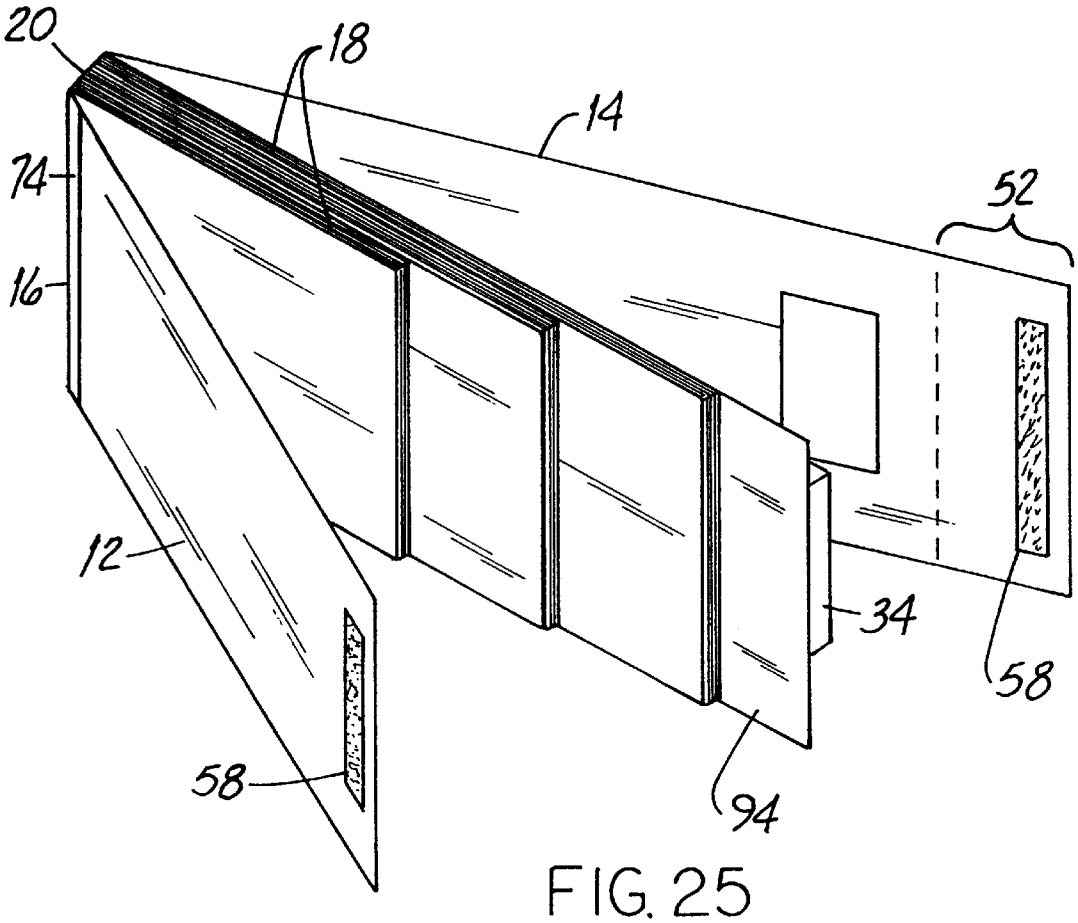
FIG. 25 is a perspective view of the photo/photo-cartridge delivery/storage packet for the Advanced Photo System showing a geometric shaped hole in registry with the APS container and a cover extension with a fastening structure that allows the extension to be folded over and attached to the opposite cover member.
Figure 28:
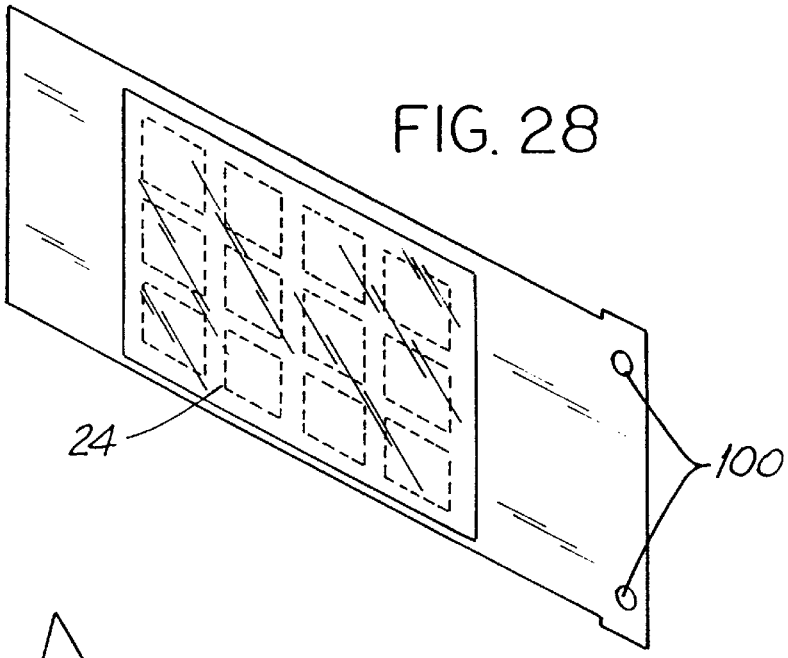
FIG. 28 is a perspective view of the insert card showing the APS index print attached to the side opposite of the APS container.

FIG. 25 shows a more preferred embodiment of the invention, wherein the first and second sheet-like cover members 12, 14 each have a spine-adjacent edge 16 and are disposed in spaced, substantially parallel planes. A sheet-like spine 74 interconnects the cover members 12, 14 along the spine-adjacent edges 16 and a plurality of sheet-like photos 18 are interposed between the cover members 12, 14 with such photos 18 being removably and replaceably secured to the spine 74 by adhesive 20. A sheet-like insert 94 (such as the one shown in FIG. 24 that is capable of being removably and replace-ably secured to the spine 74) is interposed between the cover members 12, 14. As shown in FIGS. 24 and 28, the insert 94 has an index print 24 attached to one of its sides and a structural element that secures a photo cartridge 22 to the other.

Figure 26:
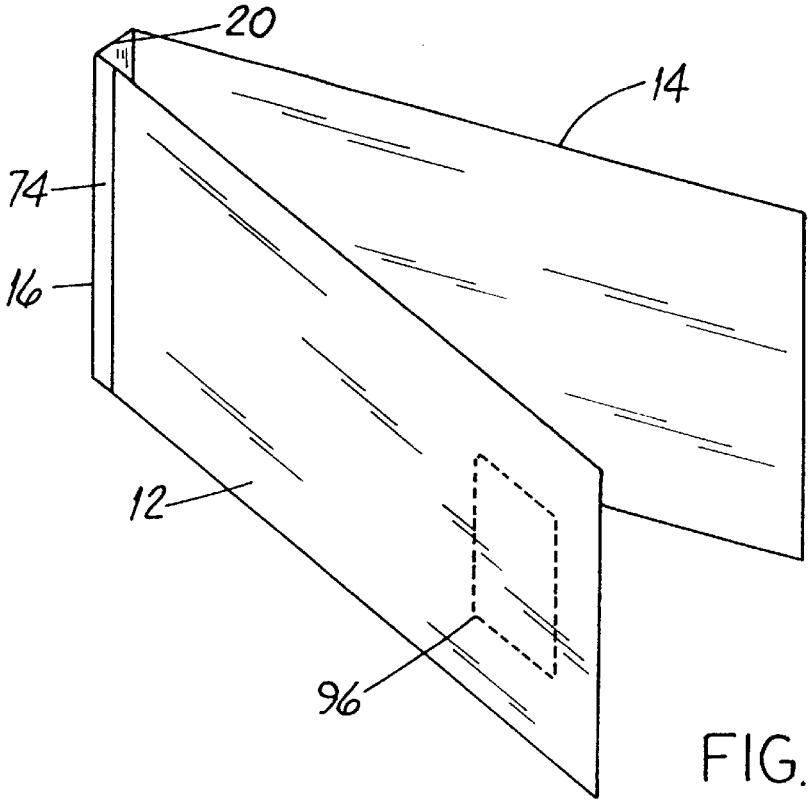
FIG. 26 is a perspective view showing only the first and second cover members of the photo/photo-cartridge delivery/storage packet for the Advanced Photo System joined by the spine member having a geometric shaped perforation on one of the cover members.
Figure 27:
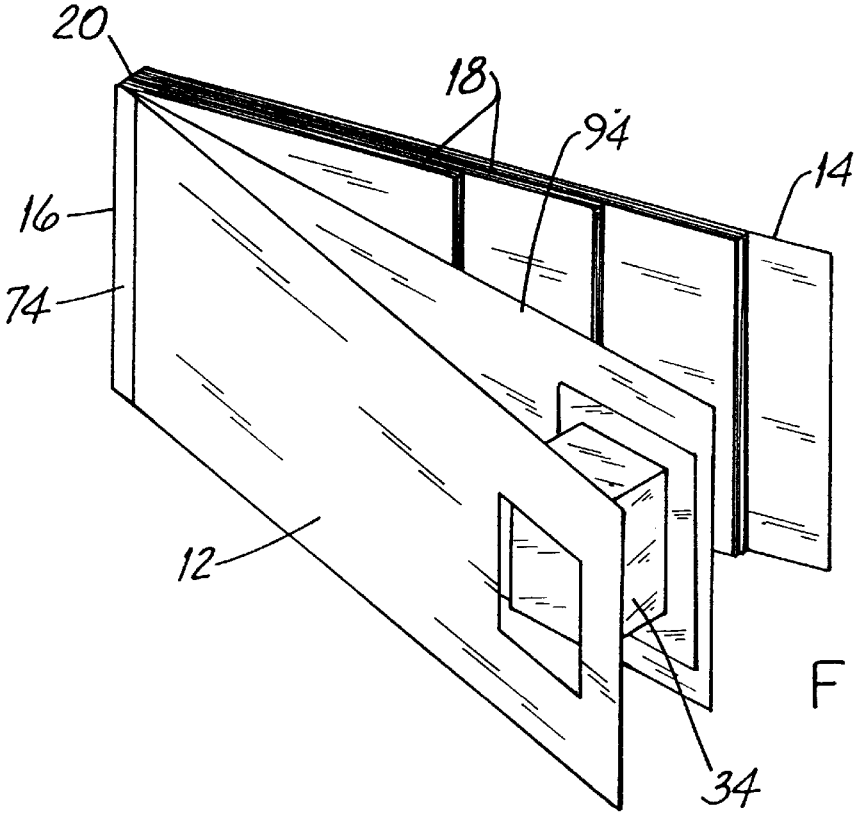
FIG. 27 is a perspective view of the photo/photo-cartridge delivery/storage packet for the Advanced Photo System that is the reverse of FIG. 25, showing a geometric shaped hole in registry with the APS container.
Figure 29:
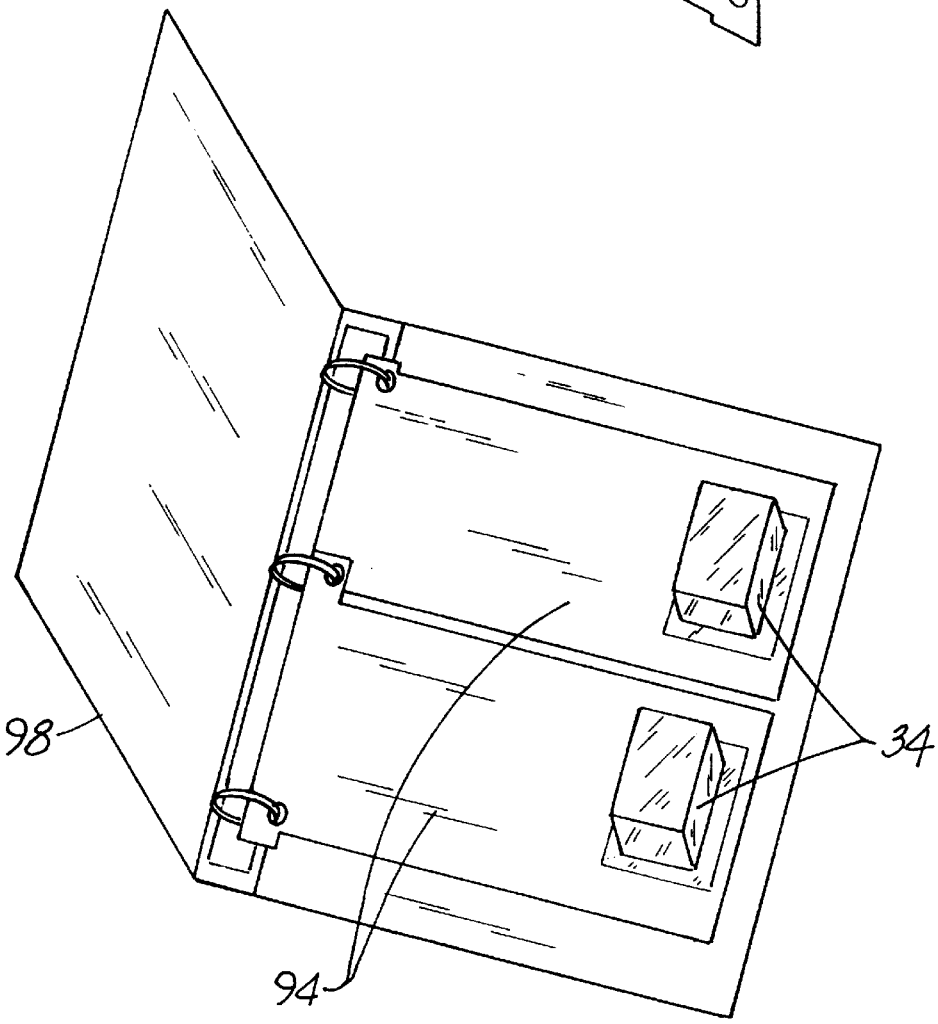
FIG. 29 is a perspective view of an auxiliary holder showing the insert cards bound with the use of a ring binder.

A more specific version of this embodiment is shown in FIG. 26. In such embodiment, the second cover member 14 includes a perforation 96 that outlines a geometric shape. In such version, the perforated geometric shape 96 is in registry with the structural element that secures the photo cartridge 22 to the insert 94. As shown in FIGS. 24, 27, and 29, the structural element is comprised of a container member 34 and adhesive 20 between the container member 34 and the insert 94.

When utilizing this particular version of the embodiment, the consumer "punches out" the geometric shape along its perforation 96. The film canister 22 is then placed in the container member 34 and the insert card 94 is attached to the spine 74 that connects the first and second cover 12, 14. In connecting the insert card 94 to the spine 74, one must orient 94 the insert so that the container member 34 faces the geometric "punch out." Since the "punch out" on the second cover 14 is in registry with the container 34, the cover 14 closes over the container 34 in such a manner that the inner surface 54 of the cover is in contact with the surface of the insert card 94.

As shown in FIGS. 25 and 27, the photographs 18 may be arranged in any order between the first and second covers 12, 14. FIG. 25 is a perspective of the storage packet 10 showing the outer surface 56 of the first cover 12 and the inner surface 54 of the second cover 14. FIG. 27 reverses the orientation and shows how the different size photographs 18 can be arranged in accordance with the user's preference.

In the preferred embodiment, the insert card 94 will be shaped so that it transitions angularly to its outer edge as shown in FIG. 24. Such angular transition will allow the outside edge of the container member 34 to act as a "pull tab" thereby aiding in its opening.

FIG. 29 shows yet another version of the more preferred embodiment wherein the invention is used in combination with an auxiliary holder 98 such as a ring binder. In this version, the surface of the insert 94 has a hole 100 or series of holes in it that allows the insert 94 to be attached to the auxiliary holder 98.

FIG. 25 shows another preferred embodiment of the invention where each cover member 12, 14 has a free edge 30 opposite its spine-adjacent edge 16. The free edges 30 are spaced such that free edge 30 of the second cover member 14 extends beyond the free edge 30 of the first cover member 12 thereby forming a cover extension 52. In such embodiment, the cover extension 52 and the first cover member 12 each have an inner surface 54 and an outer surface 56 and a fastening structure 58 is secured to the inner surface 54 of the cover extension 52 and to the outer surface 56 of the first cover member 12 in such a manner as to allow the inner surface 54 of the cover extension 52 to be attached against the outer surface 56 of the first cover member 12.

In specific versions of this embodiment, the fastening structure may be comprised of any of the following: (a) interconnecting hook and loop surfaces; (b) double-stick tape; (c) magnetic tape; and (d) an interconnecting slot-and-tab arrangement.

While the principles of the invention have been shown and described in connection with but a few embodiments, it is to be understood clearly that such embodiments are by way of example and are not limiting.

We claim:

1. A sheet-like card comprised of:

a first side and a second side;

said sides having a first edge and a second edge parallel to each other and a third edge and a fourth edge parallel to each other and perpendicular to the first and second edges;

a structural element securing a photo cartridge attached to the second side; and an index print attached to the sheet-like card.

2. The sheet-like card of claim 1 wherein the structural element comprises:

a container member; and adhesive between the container member and the second side of the insert.

3. The sheet-like card of claim 1 combination with an auxiliary holder wherein the first side of the card has a hole for attachment to the auxiliary holder.

4. The sheet-like card of claim 1 wherein:

the first edge and the second edge have a first length;

the third edge and the fourth edge have a second length; and the first length is greater than the second length.

* * * * *

UNITED STATES PATENT AND TRADEMARK OFFICE

CERTIFICATE OF CORRECTION

PATENT NO. : 6,106,014

DATED : August 22, 2000

INVENTOR(S) : Werner, Richard S. and Woods, Cary P.

It is certified that error appears in the above-identified patent and that said Letters Patent are hereby corrected as shown below:

In the Claims:

At Column 12, the first line of Claim 3

Between" claim 1" and "combination" insert --in--

Signed and Sealed this

Seventeenth Day of April, 2001

*Attest:*

Nicholas P. Godici

NICHOLAS P. GODICI

*Attesting Officer*

*Acting Director of the United States Patent and Trademark Office*